US012228124B2

(12) United States Patent
Bradshaw et al.

(10) Patent No.: US 12,228,124 B2
(45) Date of Patent: Feb. 18, 2025

(54) PERISTALTIC COMPRESSOR

(71) Applicant: The Board of Regents for the Oklahoma Agricultural and Mechanical Colleges, Stillwater, OK (US)

(72) Inventors: Craig Robert Bradshaw, Stillwater, OK (US); Colton Marcus Tubbs, Jackson, TN (US); Mazharul Islam, Stillwater, OK (US)

(73) Assignee: The Board of Regents for the Oklahoma Agricultural and Mechanical Colleges, Stillwater, OK (US)

( * ) Notice: Subject to any disclaimer, the term of this patent is extended or adjusted under 35 U.S.C. 154(b) by 100 days.

(21) Appl. No.: 17/923,178

(22) PCT Filed: May 4, 2021

(86) PCT No.: PCT/US2021/030713
§ 371 (c)(1),
(2) Date: Nov. 3, 2022

(87) PCT Pub. No.: WO2021/226131
PCT Pub. Date: Nov. 11, 2021

(65) Prior Publication Data

US 2023/0349374 A1 Nov. 2, 2023

Related U.S. Application Data

(60) Provisional application No. 63/019,717, filed on May 4, 2020.

(51) Int. Cl.
*F04B 43/14* (2006.01)
*F25B 1/02* (2006.01)

(52) U.S. Cl.
CPC ..... *F04B 43/14* (2013.01); *F25B 1/02* (2013.01)

(58) Field of Classification Search
CPC ..... F04B 43/14; F04B 43/021; F04B 45/04; F04B 45/10; F25B 1/02
See application file for complete search history.

(56) References Cited

U.S. PATENT DOCUMENTS 4,869,646 A 9/1989 Gordon et al.
6,185,944 B1 2/2001 Gaul
(Continued)

FOREIGN PATENT DOCUMENTS

EP 0484717 A1 5/1992
KR 20080109050 A * 12/2008 ..... F04B 35/045
WO WO-2014011138 A1 * 1/2014 ..... F04B 35/01

OTHER PUBLICATIONS

R.P. Adair, E.B. Qvale, J.T. Pearson, "Instantaneous Heat Transfer to the Cylinder Wall in Reciprocating Compressors," International Compressor Engineering Conference, Paper 86, (1972), https://docs.lib.purdue.edu/icec/86.

(Continued)

*Primary Examiner* — Emmanuel E Duke
(74) *Attorney, Agent, or Firm* — McAfee & Taft

(57) ABSTRACT

An apparatus for compressing a fluid has a linear compression chamber with a fluid inlet and a fluid outlet. A displacement assembly is spaced from the linear compression chamber and is actuable to engage the linear compression chamber and displace a working fluid linearly in the linear compression chamber to decrease the volume of a fluid in the linear compression chamber.

31 Claims, 21 Drawing Sheets

(56) References Cited

U.S. PATENT DOCUMENTS

| | | | |
|---|---|---|---|
| 6,213,739 | B1 | 4/2001 | Phallen et al. |
| 6,655,931 | B2 | 12/2003 | Nacher |
| 6,655,934 | B2 | 12/2003 | Mittelstein et al. |
| 10,781,809 | B2 | 9/2020 | Gould et al. |
| 2019/0032651 | A1 | 1/2019 | Velschow et al. |

OTHER PUBLICATIONS

Ian Bell, "Theoretical and Experimental Analysis of Liquid Flooded Compression in Scroll Compressors," A Dissertation Submitted to the Faculty of Purdue University In Partial Fulfillment of the Requirements for the Degree of Doctor of Philosophy, May 2011, Purdue University, West Lafayette, Indiana.

Craig R. Bradshaw, "A Miniature-Scale Linear Compressor for Electronics Cooling," A Dissertation Submitted to the Faculty of Purdue University In Partial Fulfillment of the Requirements for the Degree of Doctor of Philosophy, May 2012, Purdue University, West Lafayette, Indiana.

Craig R. Bradshaw, "Development of a Novel Peristaltic Compressor for Air-Conditioning and Refrigeration Applications," Submitted to Manager of Research and Technical Services, ASHRAE, Inc., Atlanta, GA, Project Start Date Aug. 1, 2018.

Marco Carrilho Diniz, Cesar Jose Deschamps, "Comparative Analysis of Two Types of Positive Displacement Compressors for Air Conditioning Applications," International Compressor Engineering Conference, School of Mechanical Engineering, Paper 2449, (2016), https://docs.lib.purdue.edu/icec/2449.

W.N. Lawless, R.W. Arenz, L.E. Cross, "Miniature, solid-state gas compressor," Review of Scientific Instruments 58, 1487 (1987); https://doi.org/10.1063/1.1139385, Submitted Dec. 12, 1985, Accepted May 10, 1987, Published online Jun. 4, 1998, American Institute of Physics.

Margaret M. Mathison, "Modeling and Evaluation of Advanced Compression Techniques for Vapor Compression Equipment," A Dissertation Submitted to the Faculty of Purdue University In Partial Fulfillment of the Requirements for the Degree of Doctor of Philosophy, Aug. 2011, Purdue University, West Lafayette, Indiana.

Bin Peng, Shengxian Zhao, Yaohong Li, "Thermodynamic Model and Experimental Study of Oil-free Scroll Compressor," IOP Conf. Series: Journal of Physics: Conf. Series 916 (2017) 012048, doi:10.1088/1742-6596/916/1/012048.

J.U. Ahamed, R. Saidur, H.H. Masjuki, "A review on exergy analysis of vapor compression refrigeration system," Department of Mechanical Engineering, University of Malaya, Accepted Nov. 16, 2010, Available online Jan. 12, 2011, 2010 Elsevier Ltd., doi:10.1016/j.rser.2010.11.039.

Ian H. Bell, Jorrit Wronski, Sylvain Quoilin, Vincent Lemort, "Pure and Pseudo-pure Fluid Thermophysical Property Evaluation and the Open-Source Thermophysical Property Library CoolProp," Industrial & Engineering Chemistry Research, Revised Jan. 2, 2014, Accepted Jan. 13, 2014, Published Jan. 13, 2014, dx.doi.org/10.1021/ie4033999, Ind. Eng. Chem Res. 2014, 53, pp. 2498-2508.

Craig R. Bradshaw, Eckhard A. Groll, "A comprehensive model of a novel rotating spool compressor," Accepted Jul. 6, 2013, Available online Jul. 16, 2013, International Journal of Refrigeration 36 (2013) pp. 1974-1981, http://dx.doi.org/10.1016/j.ijrefrig.2013.07.004.

Jinglong Chen, Chunlin Zhang, Minglong Xu, Yanyang Zi, Xinong Zhang, "Rhombic micro-displacement amplifier for piezoelectric actuator and its linear and hybrid model," Mechanical Systems and Signal Processing 50-51 (2015), pp. 580-593, Elsevier Ltd.

Frank Hartley, "Micropump technology and applications," Proc. SPIE 3891, Electronics and Structures for MEMS, Asia Pacific Symposium on Microelectronics and MEMS, Gold Coast, Australia, Sep. 29, 1999, doi. 10.1117/12.364470.

B. Mathew, H. Hegab, "Analytical modeling of microscale diaphragm compressors," Applied Thermal Engineering 51 (2013) pp. 130-136, Elsevier Ltd.

Margaret M. Mathison, James E. Braun, Eckhard A. Groll, "Modeling and Testing of a Two-Stage Rotary Compressor," International Compressor Engineering Conference, School of Mechanical Engineering, Paper 1892, Jul. 14-17, 2008.

Margaret Mathison, Craig Bradshaw, Ian Bell, Compressors 102, Comprehensive Compressor Analysis, Herrick Laboratories, Purdue University, Jul. 14-15, 2012.

E. Navarro, E. Granryd, J.F. Urchueguia, J.M. Corberan, "A phenomenological model for analyzing reciprocating compressors," Science Direct, International Journal of Refrigeration 30 (2007), pp. 1254-1265.

Andy Pearson, "What does the future hold for compressor manufacturers?" Journal of Process Mechanical Engineering, 2015, vol. 229(2), pp. 88-95.

M.T.A. Saif, B. Erdem Alaca, Huseyin Sehitoglu, "Analytical Modeling of Electrostatic Membrane Actuator for Micro Pumps," IEEE Journal of Microelectromechanical Systems, vol. 8, No. 3, Sep. 1999.

Abhijit A. Sathe, Eckhard A. Groll, Suresh V. Garimella, "Analytical model for an electrostatically actuated miniature diaphragm compressor," NSF Cooling Technologies Research Center, School of Mechanical Engineering, Purdue University, West Lafayette, Indiana, Jan. 21, 2008.

Abhijit A. Sathe, Eckhard A. Groll, Suresh V. Garimella, "Optimization of electrostatically actuated miniature compressors for electronics cooling," International Journal of Refrigeration 32 (2009), pp. 1517-1525.

M.A. Sulfridge, N.R.Miller, "The Mesoscopic Peristaltic Compressor," Air Conditioning and Refrigeration Center, University of Illinois, Mechanical & Industrial Engineering Dept., Urbana, IL, Jan. 2001.

T. Toyama, Y. Nishikawa, Y. Yoshida, S. Hiodoshi, Y. Shibamoto, "Reduction of Noise and Over-Compression Loss By Scroll Compressor With Modified Discharge Check Valve," Paper 1587, International Compressor Engineering Conference, School of Mechanical Engineering, Purdue University, 2002.

Jun Xie, Jason Shih, Qiao Lin, Bozhi Yand, Yu-Chong Tai, "Surface micromachined electrostatically actuated micro peristaltic pump," The Royal Society of Chemistry, Sep. 14, 2004, pp. 495-501.

International Search Report and Written Opinion mailed Oct. 1, 2021 in corresponding PCT Application No. PCT/US2021/030713, pp. 1-10.

Krishna, Abhinav, et al., "Analysis of a Rotating Spool Expander for Organic Rankine Cycles in Heat Recovery Applications", International Compressor Engineering Conference, Paper 2343, Jul. 2014, pp. 1-11.

Ferreira, R. T., et al., "Evaluation of the Leakage Through the Clearance Between Piston and Cylinder in Hermetic Compressors", International Compressor Engineering Conference, Paper 424, 1984, pp. 1-7.

Bradshaw, Craig R., et al., "Improved design method of a rotating spool compressor using a comprehensive model and comparison to experimental results", IOP Conf. Series: Materials Science and Engineering 232, 2017, pp. 1-11.

* cited by examiner

NOMENCLATURE

| | |
|---|---|
| A | Area of the compression chamber |
| $A_{leakage}$ | Leakage Area |
| $C_V$ | Specific volume |
| $h$ | Displacement of the piston when acting on the curve segment |
| $h_{in}$ | Enthalpy in |
| $h_{out}$ | Enthalpy out |
| $h_t$ | Heat transfer constant |
| $Ma$ | Mach number |
| $\dot{m}_{in}$ | Mass number |
| $\dot{m}_{out}$ | Mass flow in |
| $\dot{m}_{leakage}$ | Mass flow leakage |
| P | Pressure of the fluid |
| $\dot{Q}$ | Heat transfer rate |
| $R$ | Radius of the piston/compression chamber |
| $R_c$ | Radius of the curve segment in the compression chamber |
| $R_g$ | Gas constant |

| | |
|---|---|
| S | Actuation speed |
| T | Temperature of the fluid |
| $T_W$ | Wall temperature |
| $u$ | Internal energy |
| $V$ | Volume of the semi - circular compression chamber |
| $V_c$ | Volume of the curve segment in the compression chamber |
| $V_d$ | Internal energy |
| $Y$ | Volume of the deflected segment |
| $Z$ | Displacement of the piston |
| $\rho$ | Density of the fluid |
| $\vartheta$ | Fluid velocity |
| $\gamma$ | Specific heat |

FIG. 37

PERISTALTIC COMPRESSOR

CROSS-REFERENCE TO RELATED APPLICATIONS

This application claims the benefit of PCT Application No. PCT/US2021/030713 filed on May 4, 2021, which claims the benefit of U.S. Provisional Application No. 63/019,717 filed May 4, 2020, both applications of which are hereby incorporated by reference.

BACKGROUND

Apparatuses for compressing fluids are used in a variety of applications. One such apparatus is a compressor. Compressors are used in a wide variety of settings, including residential, commercial and industrial settings for supplying fluid at an elevated pressure. Compressors are used to provide instrument air; to power tools, paint sprayers, and abrasive blast equipment and other tools. Another use for compressors is in vapor compression cycles for refrigeration and air conditioning systems. Traditional positive displacement compressors used in such settings require valves and internal volume ratios or both to operate. These two features generate the majority of the losses in compressors.

Other types of compressors likewise have issues that compromise efficiency. Scroll compressors were introduced to eliminate the losses associated with valves and leakage but scroll compressors include internal volume ratios, which results in over/under-compression losses. The same is generally true for screw compressors. Reciprocating and rolling piston compressors do not have over/under compression losses but require valves, which results in leakage and/or porting losses associated with those components. A compressor that is able to operate without valves and with minimal over/under-compression losses will provide a significant advantage over legacy technologies. The peristaltic compressor described and claimed is a novel compressor that accomplishes valve-less compression with variable volume ratios.

BRIEF DESCRIPTION OF THE DRAWINGS

FIG. 37 is a table identifying the nomenclature for the algorithm described.

DESCRIPTION OF AN EMBODIMENT

Referring now to the figures, an apparatus for compressing a fluid is shown. In one embodiment the apparatus is a linear compressor, and may be for example a linear peristaltic compressor. The apparatus for compressing fluid 10 stimulates flow through a compressor chamber as a result of peristaltic engagement. The apparatus 10 performs compression along a linear axis from a compression chamber inlet towards a compressor chamber discharge to decrease the volume of the compression chamber and thereby increase the pressure in the compression chamber to a desired discharge pressure. The sequential compression in a described embodiment is effectuated by a compression, or displacement assembly. The compression assembly may comprise, for example, a plurality of linearly actuable pistons. The actuable pistons may reciprocate between a retracted, non-engaged position, to a fully extended position in which the piston pushes a flexible diaphragm into a chamber cavity, thereby decreasing the volume in the chamber cavity and increasing the pressure of the fluid therein. Peristaltic engagement is that engagement of the compression assembly with the flexible diaphragm. Fluid as it is used herein is meant to include any substance that is capable of flow, such as liquids, gases, plasmas and plastic solids. Other embodiments of a displacement assembly are possible, and the one described herein is exemplary. A displacement assembly used will be capable of compressing the flexible diaphragm linearly to change the volume ratio in the compression chamber.

Because the actuators for the pistons in the described embodiment are actuable independent of one another, the compression sequence of the compression assembly is adjustable on the fly. In other words, the discharge pressure can be altered during operation of the compressor 10 by changing the variables associated with the actuators, including the speed and the order of actuation of the actuators. The pistons provide for the creation of a plurality of segmented compression pockets, which allows for the isolation of the suction, or inlet and discharge, or outlet ports from one another, removing the need for valves. This feature, among others also allows for adjustment of volume ratio, and corresponding pressure, on the fly sequentially along the linear axis. The compression chamber may include a flexible diaphragm covering a cavity with a linear, or longitudinal axis. By utilizing a linear compression chamber, and peristaltically engaging the diaphragm, the compression process may be performed without the use of valves which may eliminate, or at least alleviate leakage issues thereby improving efficiency.

Figure 1:
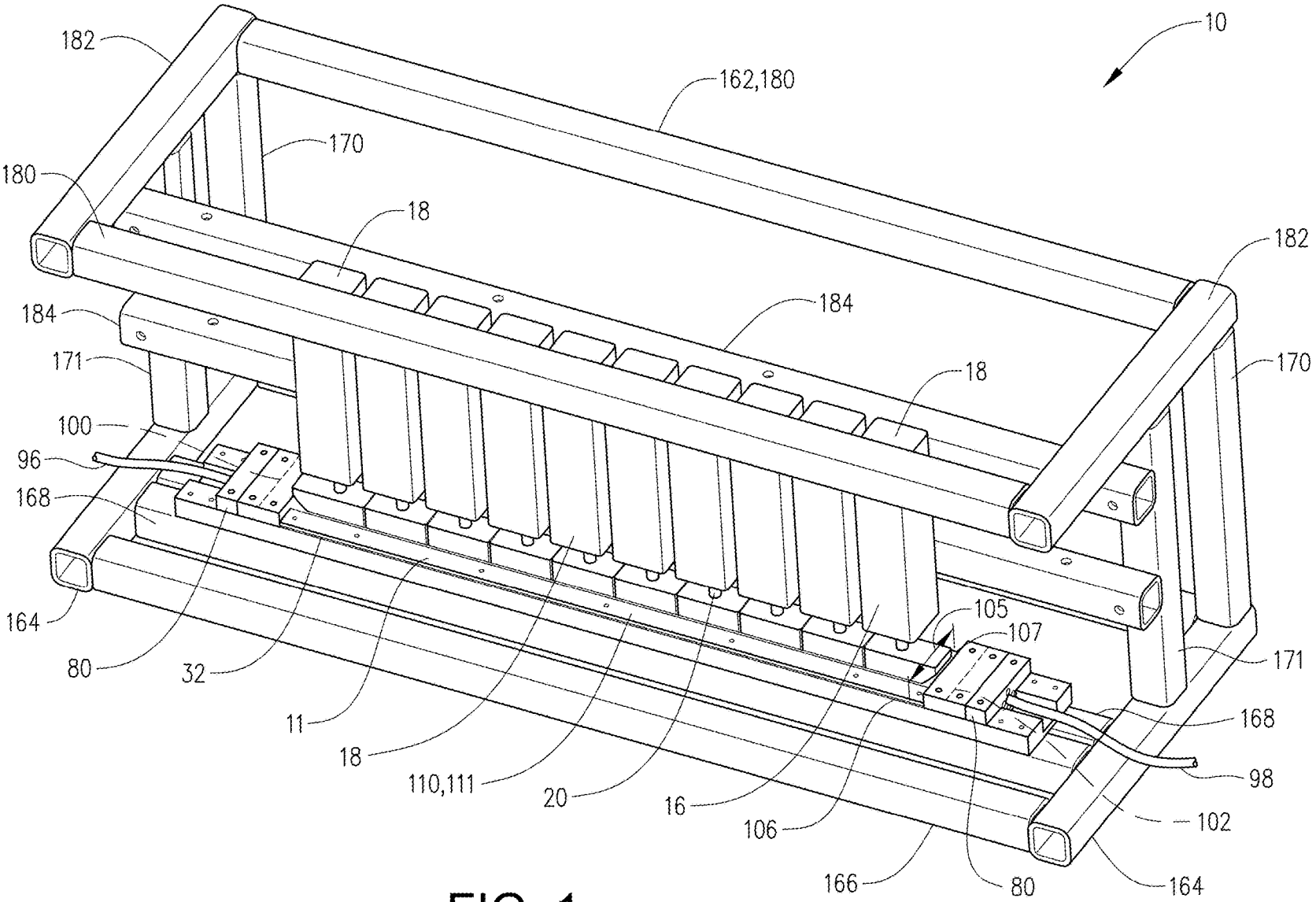
FIG. 1 is a perspective view of an apparatus for compressing a fluid.
Figure 2:
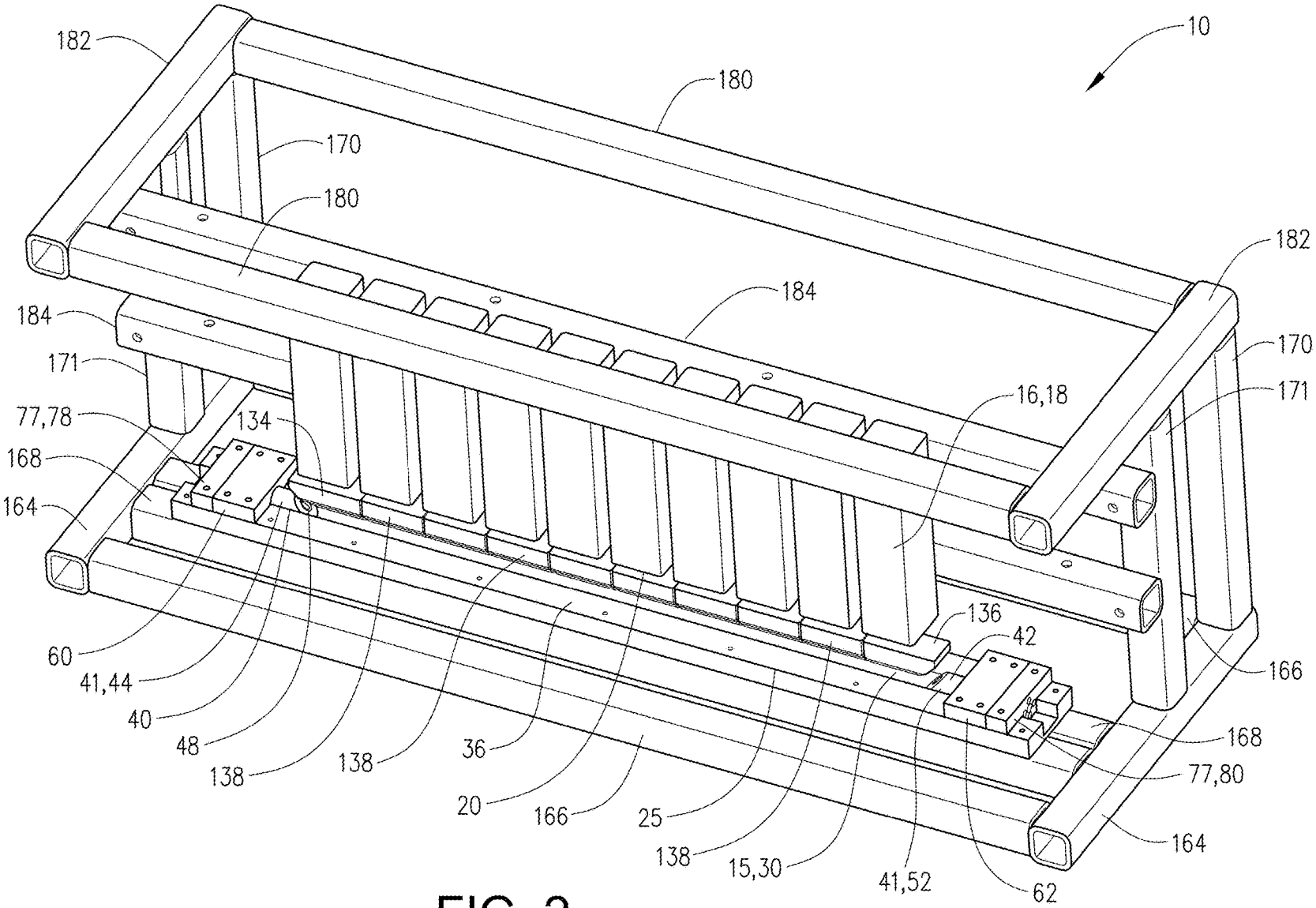
FIG. 2 is a view identical to that shown in FIG. 1 without the diaphragm.

In the embodiment of FIG. 1, an apparatus for compressing a fluid 10 comprises a linear compression chamber 15 and a compression assembly 16. The compression assembly 16 which may also be referred to as a displacement assembly 16 comprises a plurality of actuators 18 which may be linear actuators 18 that reciprocate a plurality of pistons 20. Actuators 18 may comprise electric motors of a type known in the art. The described embodiment utilizes ten pistons 20, but it is understood that more or less may be used.

Linear compression chamber 15 may comprise a longitudinally extending chamber body 25 with a longitudinal or linear axis 26. Compression chamber 15 has a first or inlet end 40 and a discharge or outlet end 42. A compression channel or cavity 30 is defined in chamber body 25 and extends along a length of at least a portion of the chamber body 25. In the embodiment described, cavity 30 is a generally semi-cylindrical cavity but can be other geometric shapes. As will be explained in more detail, piston 20 will have removable piston heads and because the cavity 30 can be a desired geometric shape, linear compressor 10 is reconfigurable in a number of ways.

A flexible diaphragm 32 extends across an upper opening 34 defined by cavity 30 along the length of the compression chamber 15. The chamber body has a first shelf 36 and a second shelf 38, each with a plurality of openings 37 therethrough which as will be explained in detail may be utilized to retain the flexible diaphragm 32 in place. The flexible diaphragm 32 will extend outwardly beyond the edges of the opening 34 onto the shelf portions 36 and 38 of chamber body 25.

A ported fitting 41 is positioned at the inlet and outlet ends 40 and 42 of compression chamber 15. Ported fittings 41 may be referred to as an inlet ported fitting 44 and an outlet ported fitting 52. The inlet ported fitting 44 and outlet ported fitting 52 are generally identical and are essentially positioned to be mirror images of one another. Ported fittings 41 have ports 46 defined therethrough. Port 46 in inlet ported fitting 44 is the inlet, or suction port and port 46 in the outlet ported fitting 52 is the outlet, or discharge port. Ported fitting 41 has a slanted inner face 48 and an outer face 50. Outer face 50 is generally perpendicular to the longitudinal axis 26 of the compression chamber 15.

Ported fittings 41 have outer surface 54. Outer face 50 has a plurality of openings 56 therein for connection to other fittings that allow flow tubing or hose to be connected thereto so that the fluid to be utilized in the compression chamber 15 may be passed therethrough. Outer surface 54 of ported filters 41 may have groove 58 therein.

Seal caps 59 which may be referred to as first and second seal caps 60 and 62 are utilized to mount ported fittings 44 and 52 to chamber body 25. Seal caps 59 include a semi-cylindrical cutout 64 which includes a first or relief portion 66 and a second or sealing portion 68. Shoulder 70 is defined by relief portion 66 and sealing portion 68.

Seal caps 59 are positioned so that flexible diaphragm 32 will extend over inner face 48 of the ported fittings 41 and will be captured between relief portion 66 of seal caps 59 and outer surface 54 of ported fittings 41. An O-ring may be received in groove 58 in the ported fittings 41. Groove 58 with an O-ring therein will be received in sealing portion 68 of seal caps 60 and 62. Seal caps 60 and 62 have a first or inner face 72 which faces toward a center of compression chamber 15 and an outward face 74. Outward face 50 of ported fittings 44 and 52 will be generally coplanar with outward face 74 of first and second seal caps 60 and 62. Seal caps 60 and 62 may be affixed to chamber body 25 with a plurality of bolts or other fasteners.

Linear compressor 10 includes seal blocks 77 which may include first and second seal blocks 78 and 80. Seal blocks 78 and 80 are positioned on the compressor 10 such that they are mirror images of one another. Seal blocks 78 and 80 include an outward face 82 and an inward face 84. Inward faces 84 will engage the outward face of seal caps 60 and 62. First and second seal blocks 78 and 80 include ports 88. Seal blocks 77 both include a cross bar or tee portion 92 with a generally rectangularly shaped downwardly extending leg 90. Leg 90 will fit into rectangular cavities 95 in the chamber body 25. Rectangular cavities 95 are defined at both of the inlet and outlet ends 40 and 42 of the compression chamber 15. Bolts or other fasteners will extend through openings 94 in seal blocks 77 and will be received in the openings 56 in the outward face 50 of ported fittings 41. Port 88 on first seal block 78 will receive an inlet hose 96 while the port 88 in seal block 80 will receive an outlet or discharge hose 98.

Flexible diaphragm 32 extends from a first end 100 to a second end 102 and covers cavity 30. Edges 100 and 102 will be adjacent shoulders 70 on seal caps 59. Flexible diaphragm 32 has a width 105 that is sufficient such that the flexible diaphragm will be positioned over the openings 37 in the shelf 36 and the shelf 38.

Seal bars 111 include first and second seal bars 110 and 112 positioned atop first shelf 36 and second shelf 38 such that the flexible diaphragm 32 is sandwiched therebetween. Fasteners are positioned and placed in openings 114 defined in first and second seal bars 110 and 112 so that the flexible diaphragm 32 is stretched across cavity 30 and is held firmly between first and second seal bars 110 and 112 and first and second shelfs 36 and 38. Flexible diaphragm 32 extends lengthwise to cover cavity 30 and is extended over outer surface 54 of the inlet and outlet ported fittings 44 and 52. The ends of the diaphragm 32 will be received in the relief portion 66 of the first and second seal caps 60 and 62, but will not extend past shoulder 70. As a result, the flexible diaphragm 32 is sandwiched between the outer surface 54 of ported fittings 41 and first and second seal caps 60 and 62. Fluid coming into compression chamber 15 will thus be provided through inlet hose 96 and inlet ported fitting 44 and will be discharged through outlet ported fitting 52 and discharge hose 98 without leaking.

Figure 4:
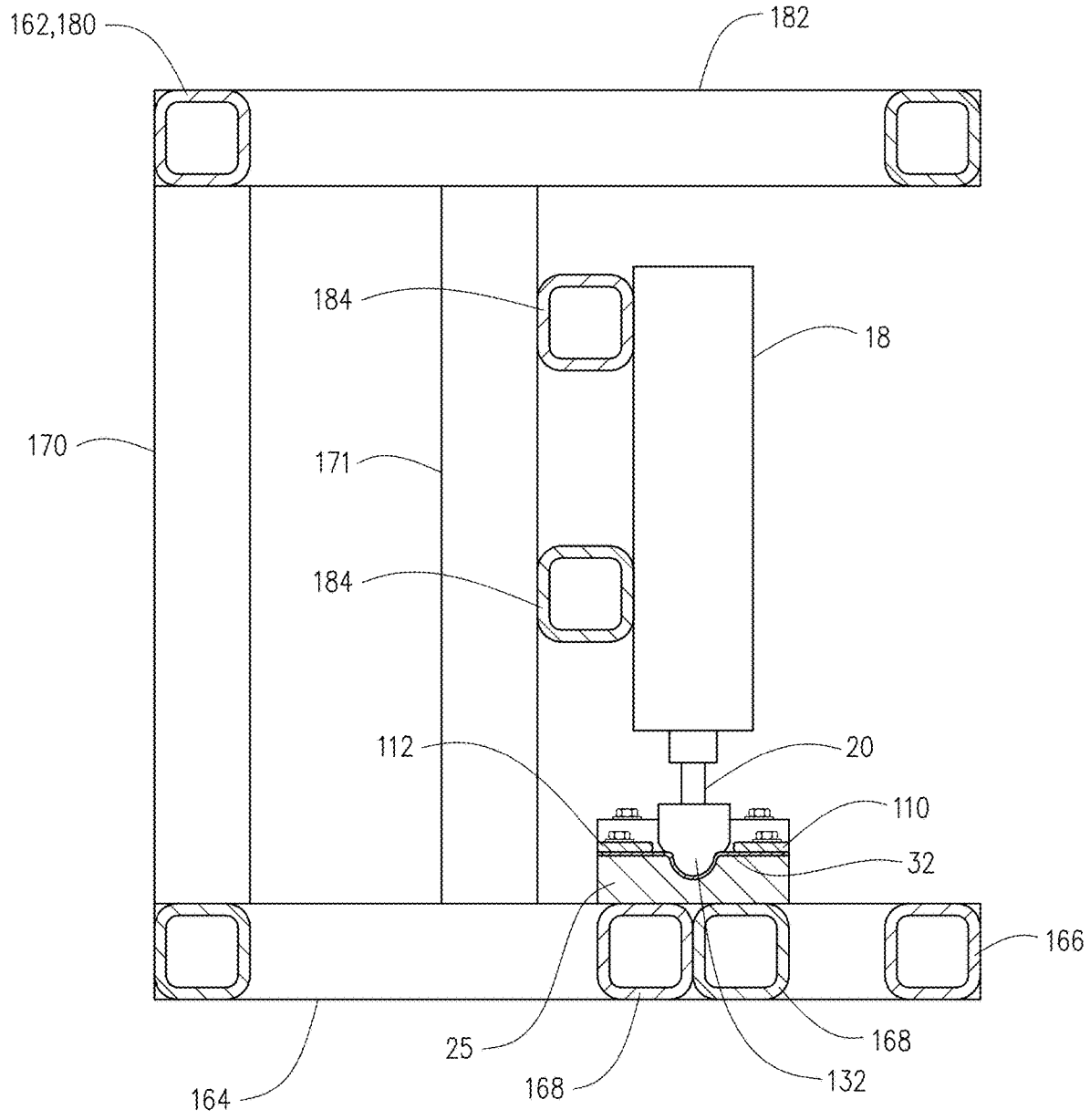
FIG. 4 is a section view from the direction of line 4-4 of FIG. 3, shown with a fully extended piston.
Figure 6:
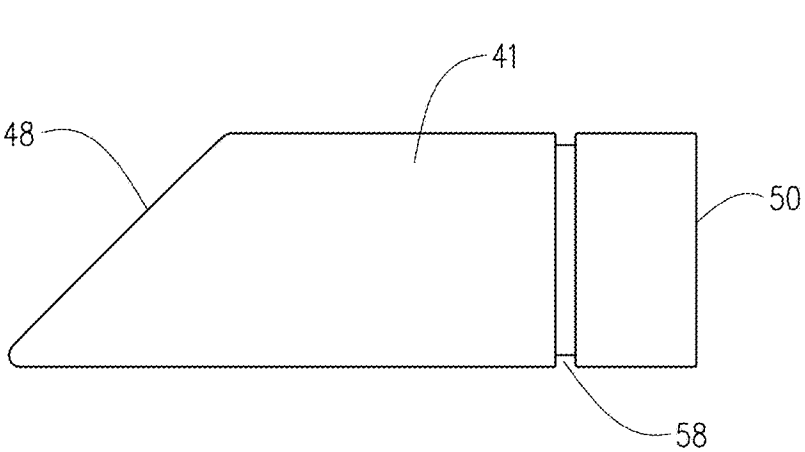
FIG. 6 is a side view of the ported flow fittings.
Figure 8:
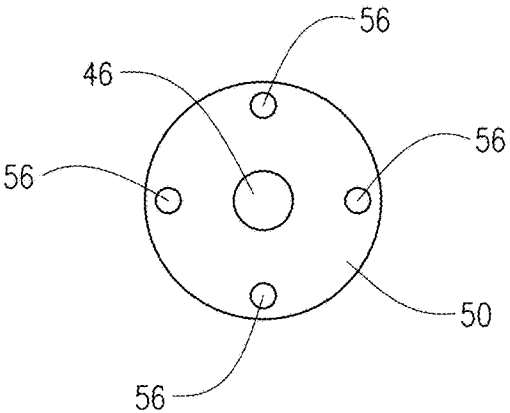
FIG. 8 is an end view of the ported flow fittings.
Figure 5:
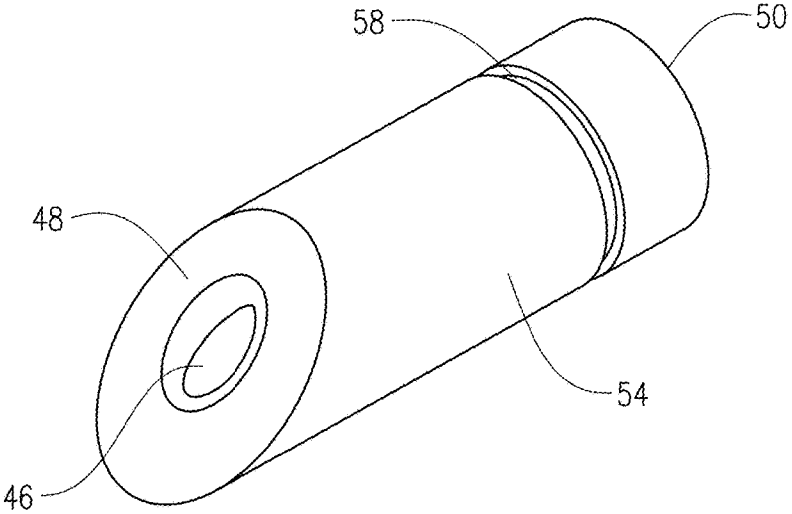
FIG. 5 is a perspective of ported flow fittings.
Figure 7:
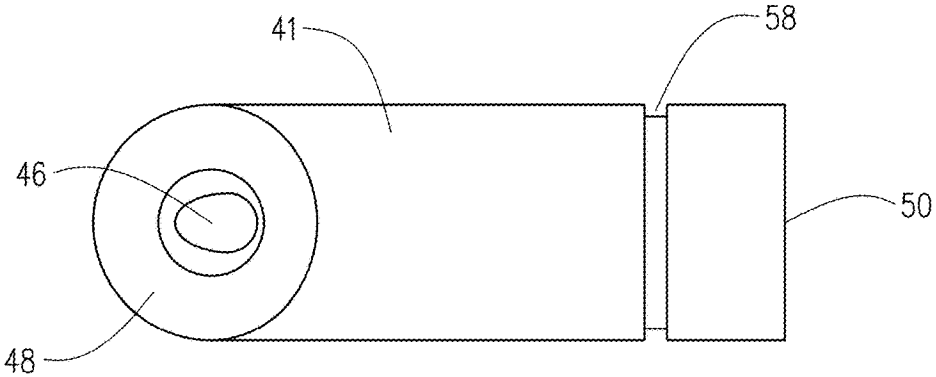
FIG. 7 is a top view of the ported flow fittings.
Figure 9:
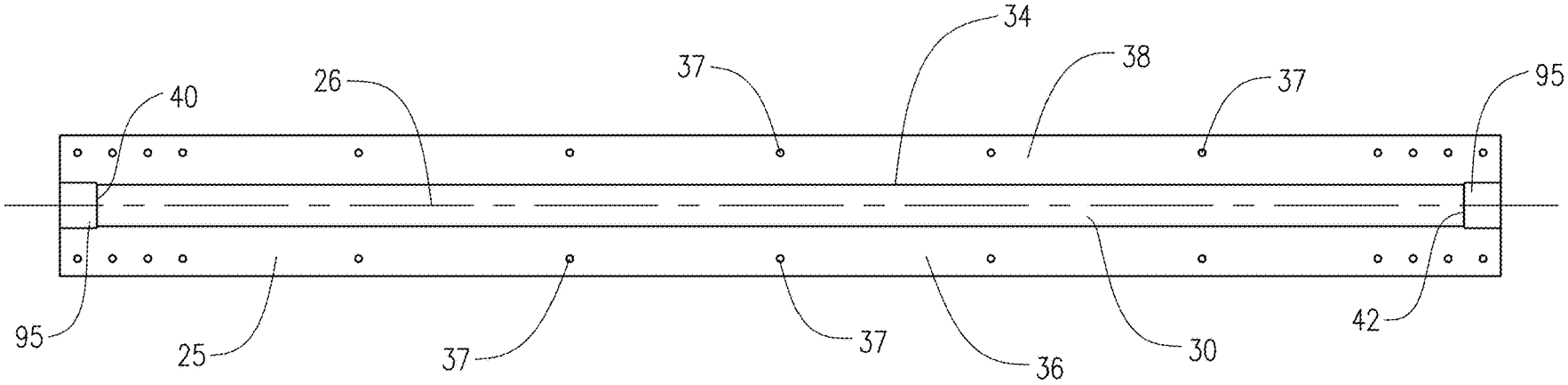
FIG. 9 is a top view of the chamber body of the disclosed embodiment.
Figure 10:
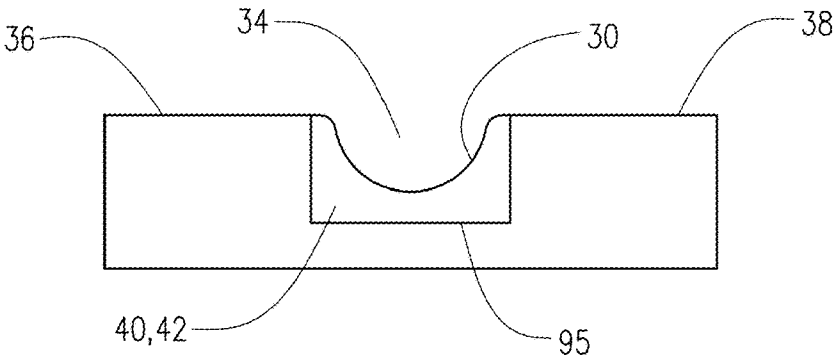
FIG. 10 is an end view of the chamber body.
Figure 11:
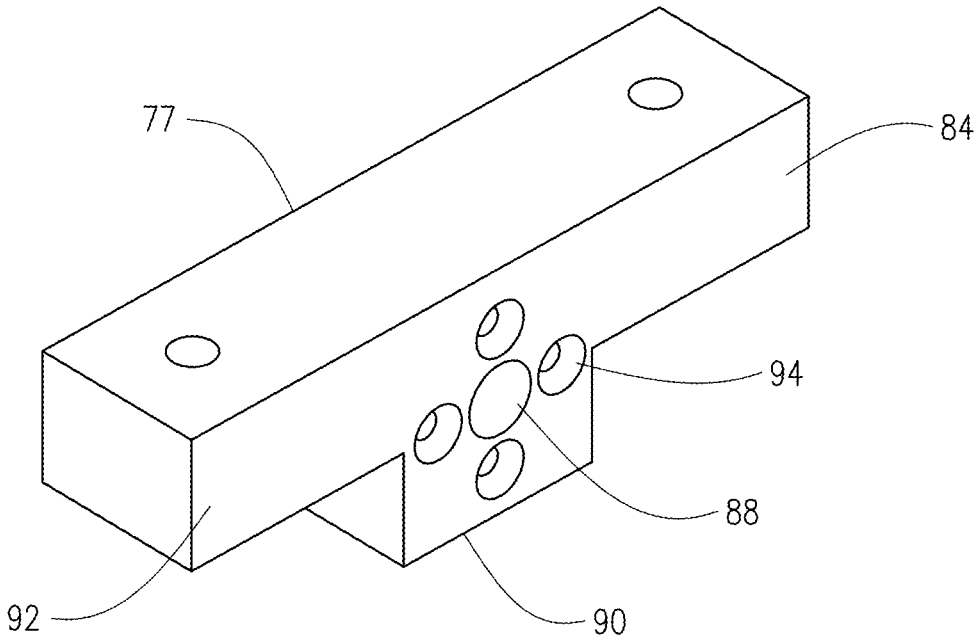
FIG. 11 is a perspective view of the inner face of the end seal block.
Figure 12:
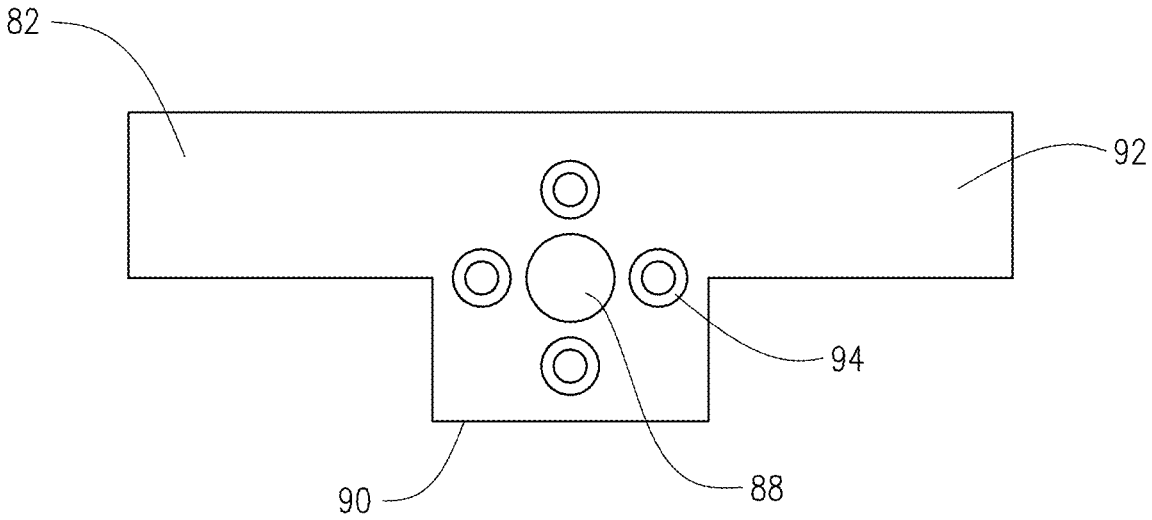
FIG. 12 is a view of the outer face of the end seal block.
Figure 13:
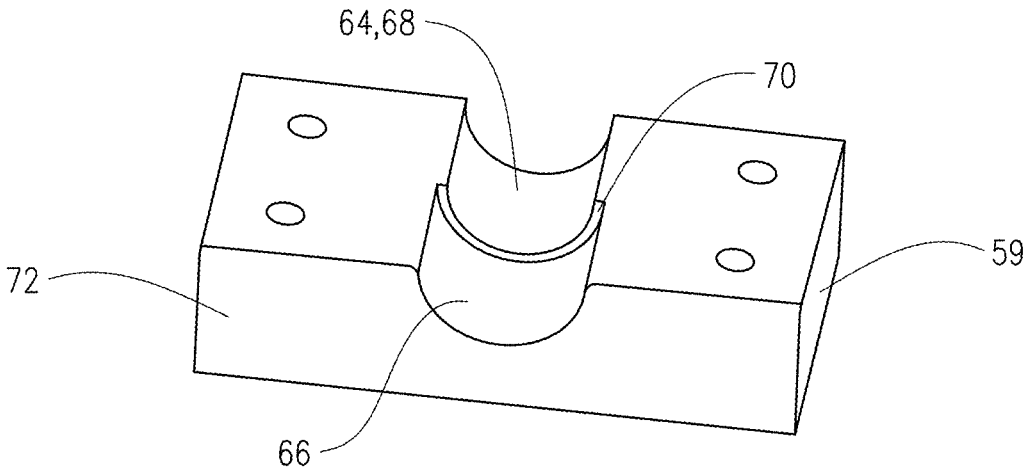
FIG. 13 is a perspective view of a seal cap.
Figure 14:
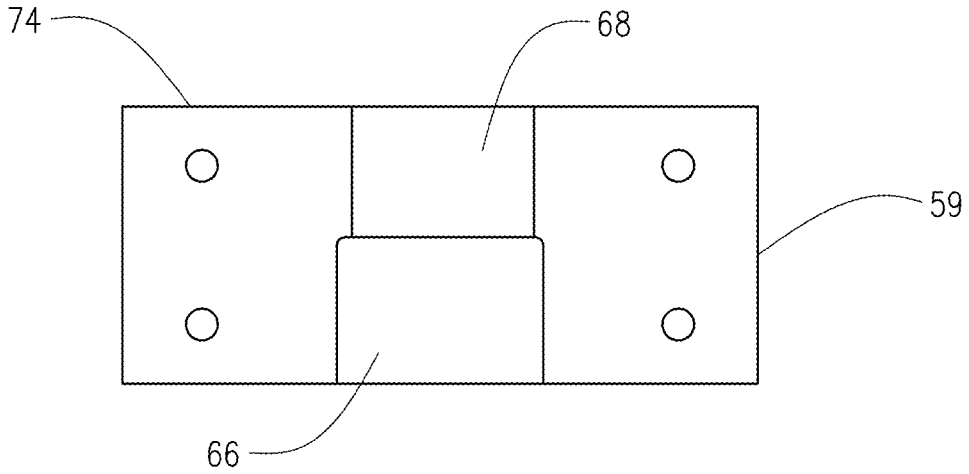
FIG. 14 is a bottom view of a seal cap.
Figure 15:
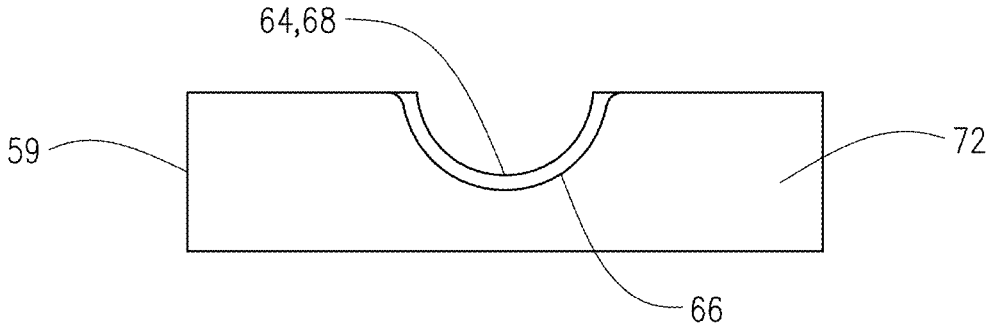
FIG. 15 is an end view of a seal cap.
Figure 16:
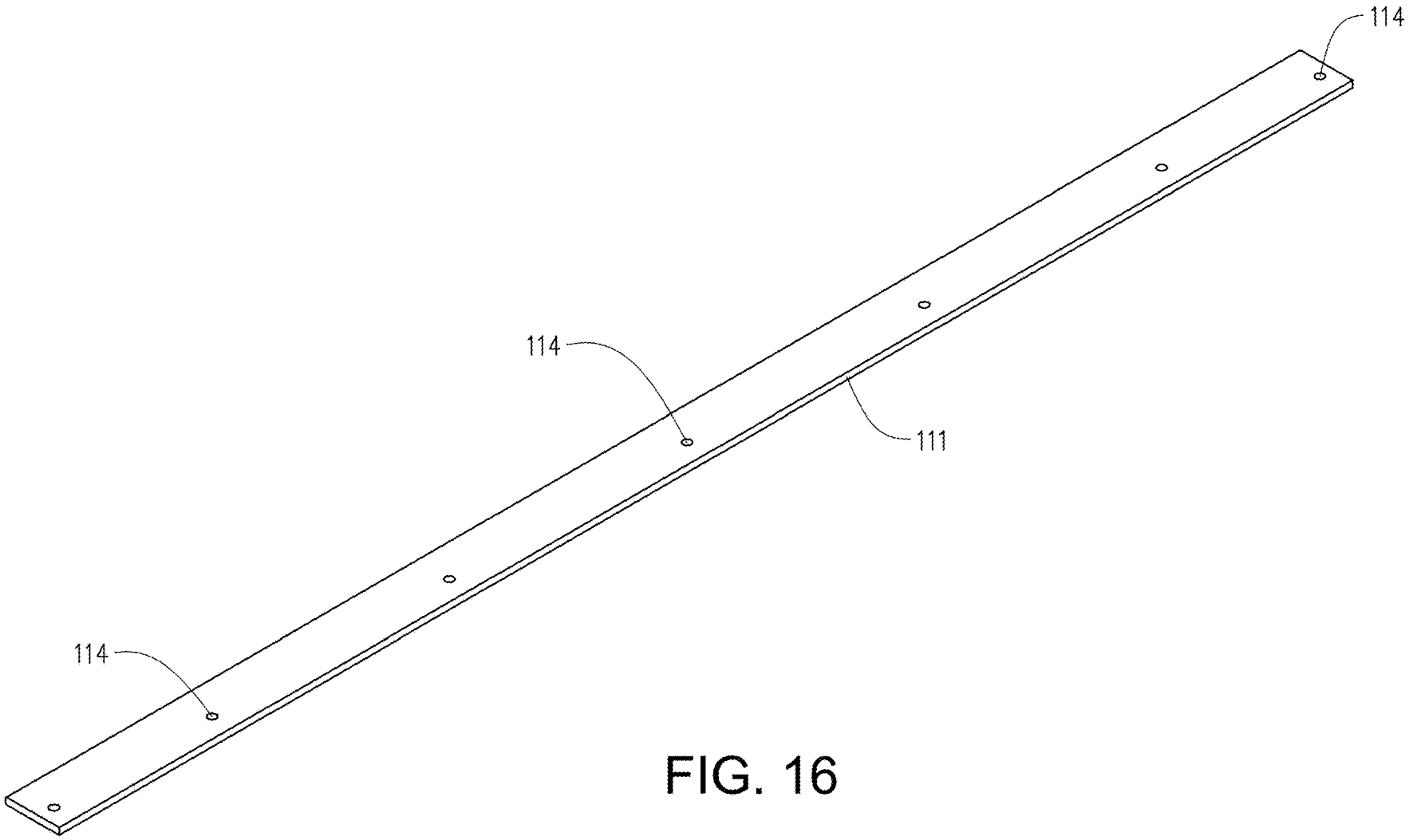
FIG. 16 is a perspective view of a seal bar.
Figure 17:
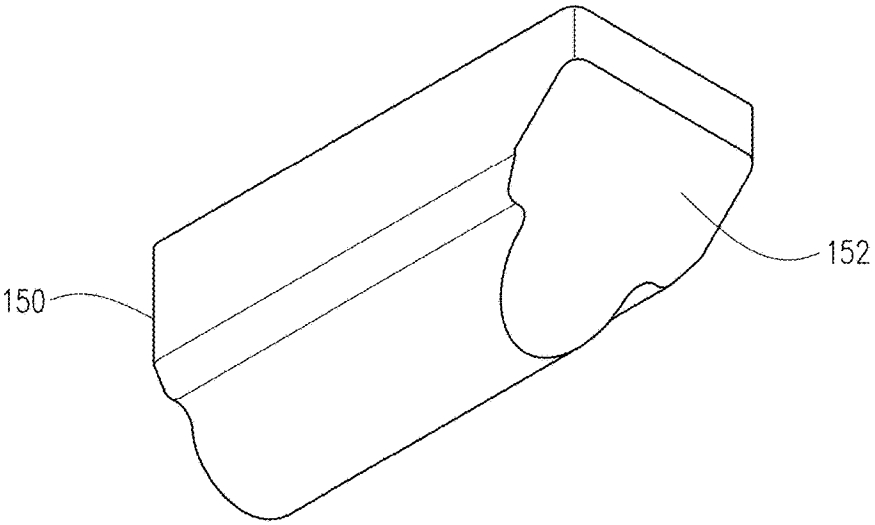
FIG. 17 is a perspective view of an end piston head.
Figure 19:
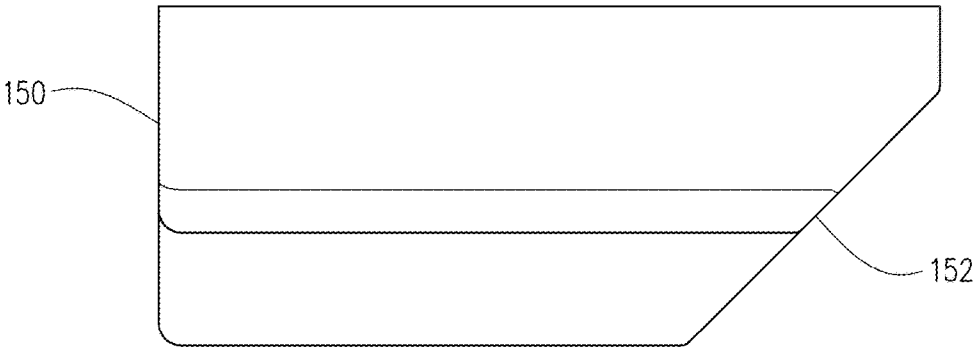
FIG. 19 is a side view of an end piston head.
Figure 18:
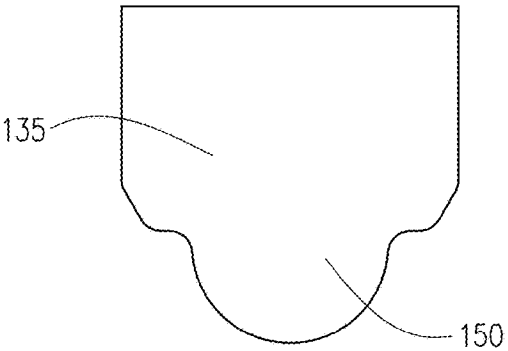
FIG. 18 is an end view of an end piston head.
Figure 20:
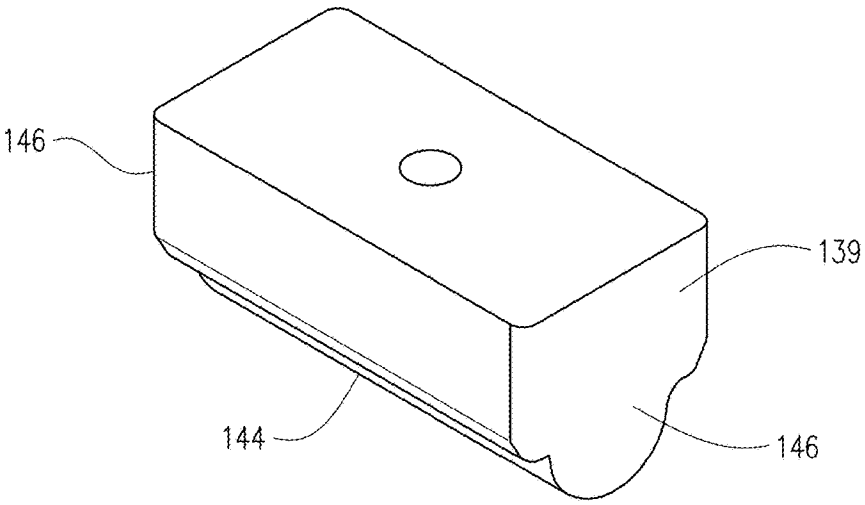
FIG. 20 is a perspective view of an intermediate piston head.
Figure 22:
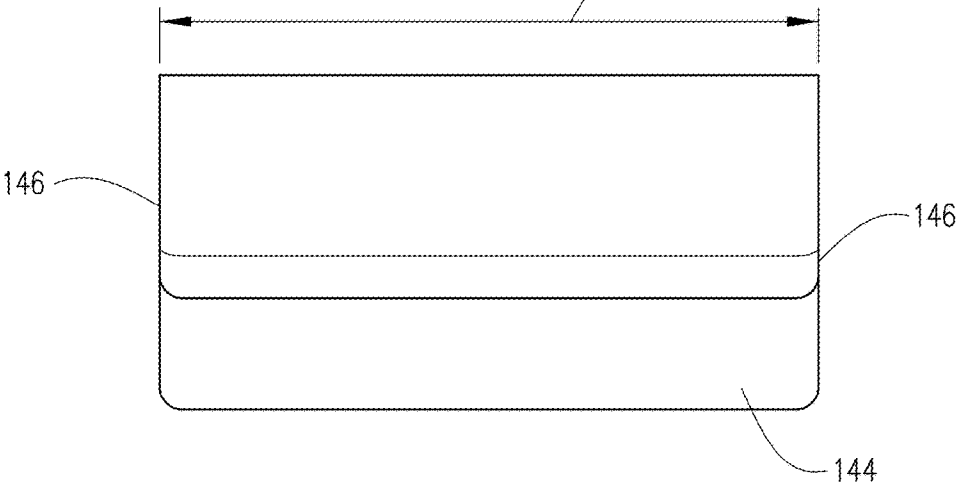
FIG. 22 is a side view of an intermediate piston head.
Figure 21:
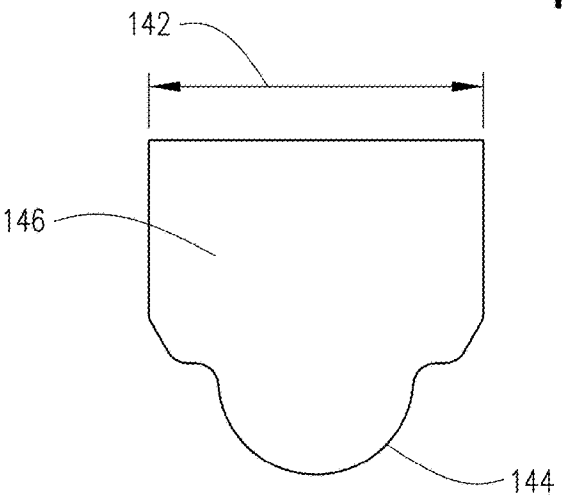
FIG. 21 is an end view of an intermediate piston head.

The compression, or displacement assembly 16 comprises the plurality of reciprocable pistons 20 comprising a piston rod 130 and piston head 132. Pistons 20 are actuatable or reciprocable between a retracted position in which the piston head 132 does not engage flexible diaphragm 32, to a fully extended position in which the piston head 132 presses on and pushes diaphragm 32 into cavity 30. In the fully extended position pistons 20 may in some cases push the diaphragm 32 to contact the surface of cavity 30 which is shown in the cross section of FIG. 4. The volume of the compression chamber 15 will change as a piston head 132 engages flexible diaphragm 32 and presses downward so as to push the diaphragm downward into cavity 30.

In the embodiment described, compression assembly 16 has a plurality of pistons 20 actuated by the plurality of actuators 18. Actuators 18 may comprise linear actuators driven by electric motors or by other means known in the art. The embodiment described includes ten pistons 20 but it is understood that a linear compressor 10 of the type described may include more or fewer than ten pistons 20. The embodiment described includes an inlet or first piston 134, an outlet or last piston 136 and a plurality of intermediate pistons 138 therebetween. First piston 134 has piston head 135, and last piston 136 has piston head 137. Intermediate pistons 138 have piston heads 139.

Figure 3:
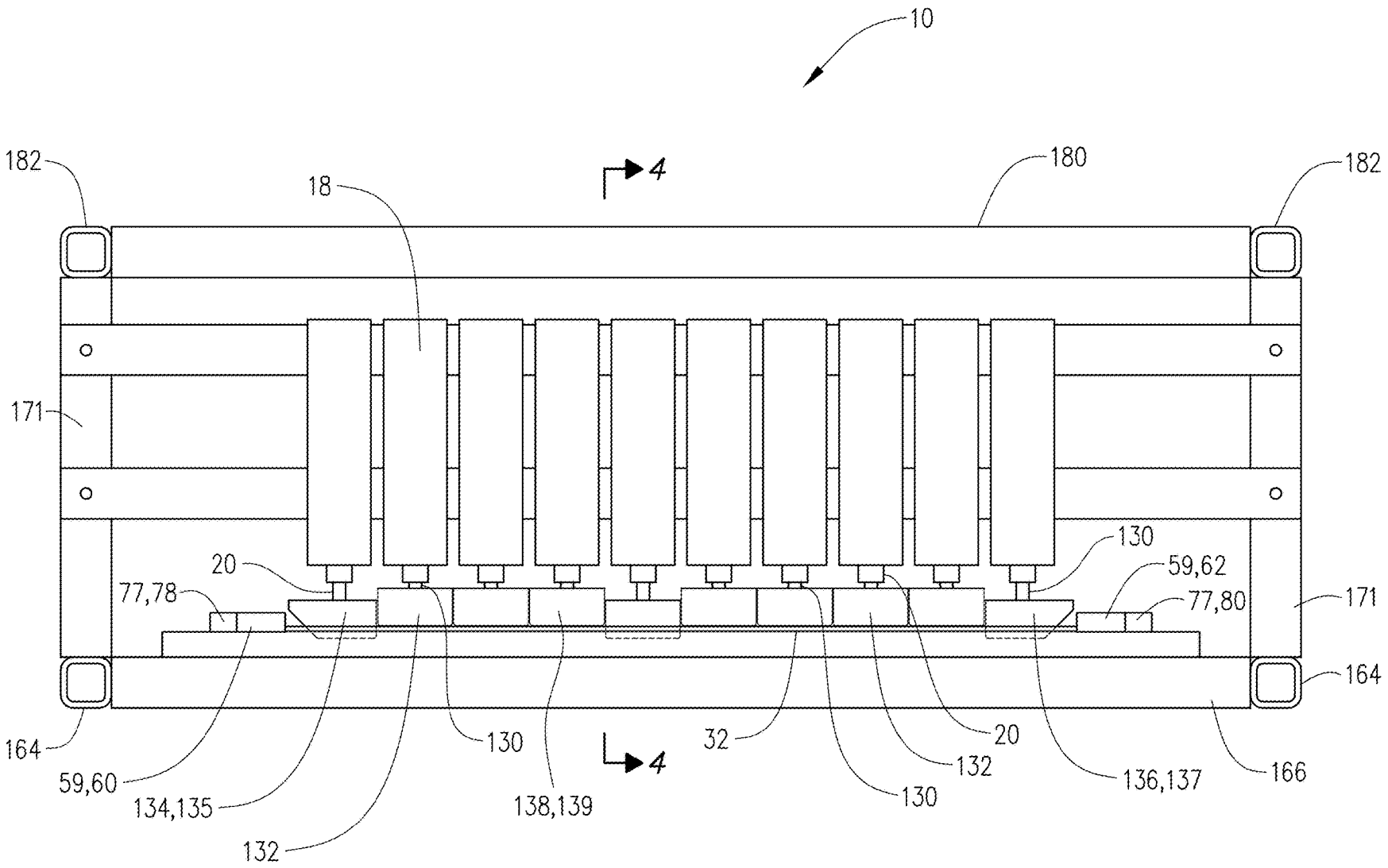
FIG. 3 is a side view of the apparatus showing first and last actuators in fully extended positions in which the flexible diaphragm is compressed.

Each of the piston heads 132 has a profile that will generally match the shape of cavity 30. Thus, piston heads 132 have a generally semi-cylindrical profile to match the semi-cylindrical shape of cavity 30. In the embodiment described, first and last piston heads 135 and 137 are identical, and are shaped differently than the intermediate piston heads 139. Intermediate piston heads 139 have a length 140, a width 142 and a semi-circular engagement profile 144. As noted, the engagement profile in the described embodiment is semi-cylindrical, or in other words semi-circular in cross section but can be any desired geometric shape. The engagement profile of the piston heads will generally align with or match the profile of cavity 30. Intermediate piston heads 139 have end faces 146 that are generally parallel to one another and vertical in orientation when viewed from the perspective of FIG. 3. In other words, the end faces 146 are oriented perpendicularly to the longitudinal central axis of cavity 30. End faces 146 will be proximate adjacent end faces 146 and be movably positioned relative to the faces 146 of adjacent piston heads 139. In other words, in the embodiment described, adjacent end faces 146 may have a slight gap therebetween to prevent any friction from occurring. Piston heads 135 and 137 on the first and last pistons 134 and 136 have an inward face 150 and an outward face 152. Outward face 152 is that face closest to ported fittings 41 at the ends of the compression chamber 15. Inward faces 150 are generally parallel to the end faces 146 of piston heads 139 on intermediate pistons 138. The inclination of sloped outward face 152 will generally match the inclination of the slope of the inner face 48 of ported inlet and outlet fittings 44 and 52. This configuration provides for a more complete sealing of the ports in the inlet and outlet ported fittings 44 and 52 when the first and last pistons 134 and 136 are fully extended to block flow therethrough.

All of the pistons are driven by actuators which may be for example electric motors of a type known in the art. Such motors can be programmed in a manner known in the art to actuate at different speeds, different times and in different modes. For example, the sequencing of the extension and retraction of each of pistons 20 can be programmatically controlled using for example Rockwell Automation's Studio 5000 programming language.

Actuators 18 may be mounted to a support structure 162 which comprises a pair of lower end beams 164 and lower side beams 166 extending between and connected to lower end beams 164. Structure 162 may further comprise parallel intermediate beams 168 extending between lower end beams 164 to which chamber body 25 may be connected. Support structure 162 may include a pair of vertical posts 170 extending upward from rear corners where end and side support beams 164 and 166 meet and may likewise include a pair of intermediate vertical posts 171 extending upward from end beams 164. An upper horizontal side beam 180 may extend between the rear vertical end posts 170. Likewise, a pair of upper end beams 182 may be connected to the upper end of the vertical posts 170. A pair of horizontal motor support beams 184 extend between and are connected to vertical intermediate supports 171 thereto. Actuators 18 may be mounted to the horizontal support beams 184.

The compressor 10 can operate in a plurality of modes and can create a plurality of desired or selected volume and compression ratios thus providing for a plurality of pressures that may be achieved at the discharge of linear compressor 10. In the embodiment described the first and last pistons 134 and 136 operate as suction and discharge pistons of the valveless compressor. Fluid may be compressed and different volume ratios achieved by using what will be denoted a "pivotal piston" which indicates when fluid from the compression chamber will begin to discharge. As previously described, the actuators 18 may be programmatically controlled by a programmable logic controller (PLC). For example, the actuators 18 may be programmed using Rockwell Automation's Studio 5000 programming language. The program is designed to provide a straightforward and intuitive way to operate the peristaltic compressor 10. Only three operations must be performed by a user; turning on the motor, selecting the appropriate sequence, or motion pattern for the actuators 18 and their attached pistons 20, and starting and stopping the compression cycle.

The desired discharge pressure will typically be selected based on the pressure of the overall system in which the apparatus 10 is used. Thus, the desired discharge pressure will be known, and in order to operate efficiently the pressure within the compression chamber at the time of discharge should not deviate from the desired discharge pressure beyond an acceptable range of deviation prior to the time the fluid is discharged. In other words, the apparatus 10 should not operate at an overpressure or under pressure condition. In the overpressure condition the pressure in the compression chamber will be higher than the discharge pressure. In the underpressure condition, the internal pressure of the compression chamber at the time of discharge will be less than the selected, or desired pressure. The internal pressure of the compression chamber can be monitored, and if a deviation from a desired discharge pressure is noted at the time of discharge the user can change the motion pattern of the pistons 20. This operation is described more fully below.

The user can control the volume/compression ratio, and the resulting internal pressure of the compression chamber of the apparatus 10 by selecting an actuator 18 as a selected pivotal piston 20 which indicates when the fluid from the compression chamber 15 will begin to discharge, or by selecting an actuator as a sectioning actuator and associated piston 20 which will create several compression pockets. In order to achieve different volume ratios, different actuation modes can be used. Modes identified as Mode 1 and Mode 2 are discussed below but other modes are possible. Each mode has several motion patterns that can be used to operate the compression process.

Figure 23:
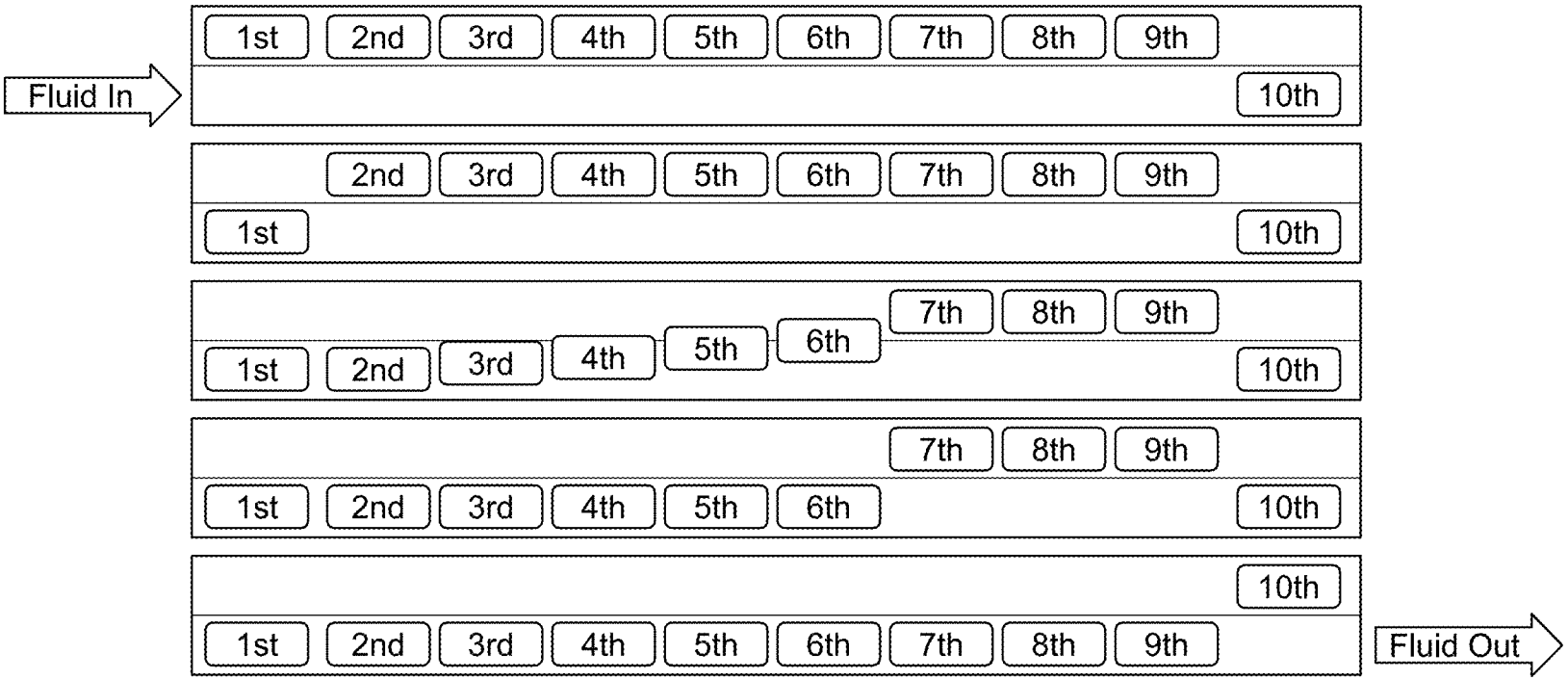
FIG. 23 is a graphic representation of one operation mode.

As an example, for Mode 1 the seventh piston utilized as a pivotal piston is illustrated in FIG. 23. At the beginning of a compression cycle, the outlet piston 136 will be in a fully extended position to prevent flow through the discharge end of the compression chamber 15 through the outlet ported fitting 52. The compression chamber 15 will be filled with fluid. At step two the first piston 134 will fully extend to press the diaphragm 32 against the surface of the cavity 30 and will isolate the fluid within the linear compression chamber 15. At the beginning of compression, the second to sixth piston will sequentially engage and press the diaphragm 32 thus sequentially compressing the fluid to a significantly smaller volume. Thereafter, and once the sixth piston is fully extended to fully depress the diaphragm the seventh to ninth pistons will simultaneously depress and the last or in this case the tenth piston will rise to allow fluid to discharge into the overall system into which it is placed. The compression process can be controlled to achieve a plurality of different volume ratios of operation by selecting different pivotal pistons. The pivotal piston can be for example adjusted from the third to the ninth to achieve different volume ratios. By achieving different volume ratios, different compression ratios are accomplished and a resultant plurality of internal pressures for the compression chamber 15 that will occur prior to the end of the compression cycle. Compression and expansion of the diaphragm 32 is continued continuously to operate the linear compressor 10. As a result, an operator can adjust the volume ratio by adjusting the sequence of linear compression by pistons 20, to bring the internal compression of the compression chamber 15 back to the desired discharge pressure, thereby reducing the possibility of an over pressure or under pressure occurrence. The adjustment can occur during the continuous operation of the apparatus 10.

Figure 24:
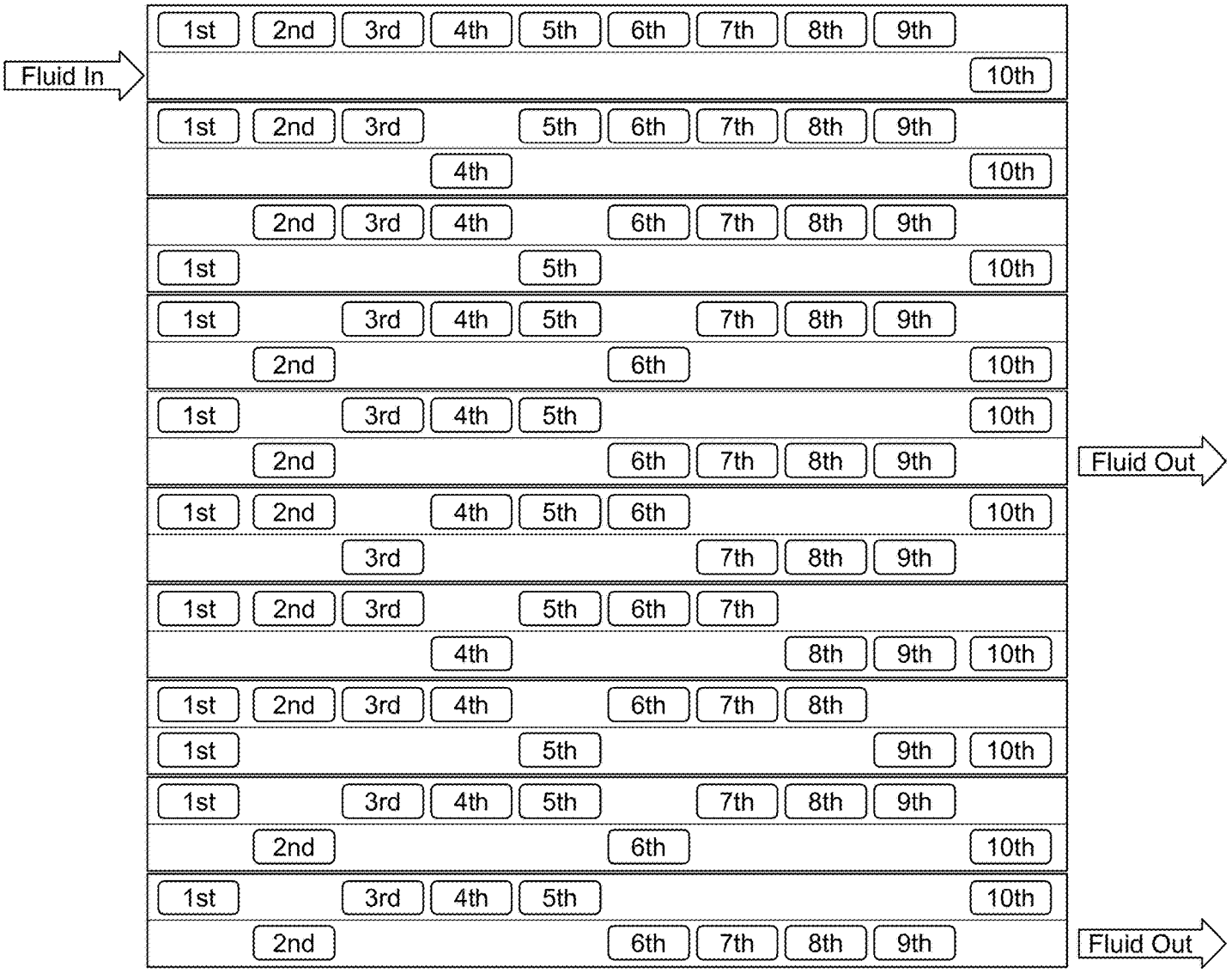
FIG. 24 is a graphic representation of an additional operation mode.

Other modes of operation are possible as well. In an exemplary Mode 2, at the beginning of a compression cycle, the outlet piston 136 (in the embodiment described the tenth piston) will be in a fully extended position to prevent flow through the discharge end of the compression chamber 15 through the outlet ported fitting 52. The fourth piston may act as a sectioning piston and piston seven in this example will be the pivotal piston. This is represented in FIG. 24. In this mode, there are two pockets present at any instant that are three pistons wide, separated by the sectioning piston. The pockets are compressed by the pistons from the pivotal piston onward or moved toward the discharge by the sequential actuation. Steps 1-5 highlight how this process is initiated while steps 6-10 present how compression is completed. At the conclusion of step 10, the process repeats from step 6. As explained, the linear compressor in different modes can be controlled to achieve a large variety of volume ratios by selecting different pivotal pistons and sectioning pistons.

A compressor may be thermodynamically modeled utilizing the unsteady mass and energy balance of a control volume, assuming all work is done by boundary work. This model is called a mechanistic chamber model. The mechanistic chamber model requires an instantaneous volume of the peristaltic compressor. In the reconfigurable peristaltic compressor 10 described, the linear actuators 18 operate pistons 20 sequentially to generate volume change. Various diaphragm shapes can have impact on the overall efficiency of the compressor. A model for the peristaltic compressor 10 was analyzed using the semi-circular compression chamber 15 described.

Figure 25:
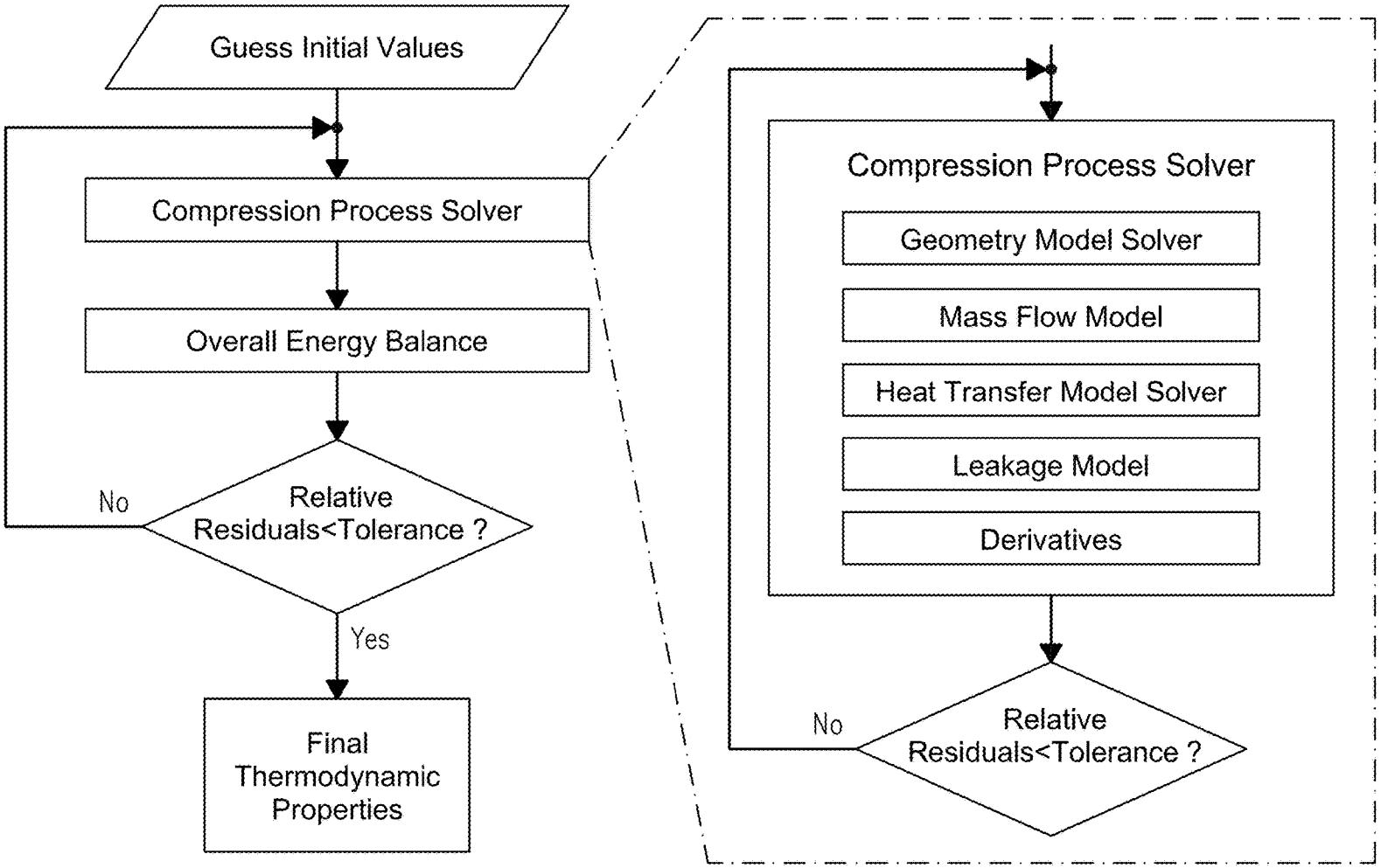
FIG. 25 is a computational algorithm for a mechanistic chamber model of the apparatus.

Density (ρ) and temperature (T) are the two independent properties in the thermodynamic model, which are related using the mass and energy conservation relation. To account for the plurality of embodiments and actuation techniques the peristaltic compressor may encounter, the thermodynamic relationships that govern were developed as a function of vertical displacement, Z. The actuation process gradually increases the pressure (P) of the fluid by reducing the volume (V) of the compression chamber. FIG. 25 shows the computational algorithm for the mechanistic chamber model of the peristaltic compressor 10 highlighting the compression process solver and its required sub-models, which are discussed below.

The compression process equations are derived using an unsteady mass and energy balance equations. The equations provide the state of the working fluid in the compression chamber at any point during the compression process and are solved for each control volume at a particular displacement of the actuator (Z). The density of the system can be determined by differentiating the equation with displacement, which is computed as, $$\frac{d\rho}{dZ} = \frac{1}{V}\left(\frac{1}{S}\left(\sum \dot{m}_{in} - \sum \dot{m}_{out}\right) - \rho\frac{dV}{dZ}\right), \quad \text{(Eq. 1)}$$

In the above equation, S represents an actuation speed, and compression chamber volume, V which will be changed for each compression step. The parameters from the mass balance equations would solve the energy balance equations in order to find the other derivatives. The conservation of energy for a general control volume can be written as follows, $$\frac{dE_{cv}}{dt} = \dot{Q} - \dot{W} + \sum \dot{m}_{in}h_{in} - \sum \dot{m}_{out}h_{out} \quad \text{(Eq. 2)}$$

The equation can be expanded in terms of changes in internal energy and mass. The following relation is the energy balance equation, which can be obtained by differentiating the expanded equation with displacement $$\frac{dT}{dZ} = \frac{1}{\rho V C_v} \left\{\frac{1}{S}\left(\dot{Q} + \sum \dot{m}_{in}h_{in} - \sum \dot{m}_{out}h_{out}\right) - uV\frac{d\rho}{dZ} - \left(u\rho + T\left(\frac{\partial P}{\partial T}\right)_v\right)\frac{dV}{dZ}\right\}, , \quad \text{(Eq. 3)}$$

Equations 1 and 3 require a series of inputs that are also functions of the instant in time, called sub-models as highlighted on the right-hand side of FIG. 25. The following paragraphs outline the sub-models required to provide complete solutions to the compression process equations including a sub-model for geometry, mass flow, heat transfer and leakage.

The following equation may be used to determine the deflected volume (Vd) of the chamber during the actuation:

$$V_d = \left(R^2\cos^{-1}\left(1 - \frac{Z}{R}\right) + (R - Z)\sqrt{2ZR - Z^2}\right)Y,$$

Y is depth of the piston and in the example considered (i.e., compression chamber with a semicircular profile) Z is changing from 0 to R, meaning prior to the time that a piston has engaged the compression chamber the displacement is 0 and sequentially increases until the piston pushes the diaphragm so that it touches the surface of the semi-circular cavity when the piston is fully extended, in which the maximum deflection would be R. However, there is a curve in both sides of the compression chamber with radius (Rc) which must be considered during the volume change. The following equation is used to derive the volume of the curve segment (Vc), $$V_c = \left(R_c^2\cos^{-1}\left(1 - \frac{h}{2R_c}\right) - \frac{1}{4}(2R_c - h)\sqrt{(4R_c - h)h}\right)Y, \quad \text{(Eq. 5)}$$

Considering h to be the displacement of the curved section the semi-circular compression chamber's final volume (V) may be calculated by subtracting Vd and Vc from the total volume with the following equation;

$$V = \frac{\pi}{2}R^2 + \left(2R_c^2 - \frac{1}{2}\pi R_c^2\right) - V_d - V_c, \quad \text{(Eq. 6)}$$

Figure 26:
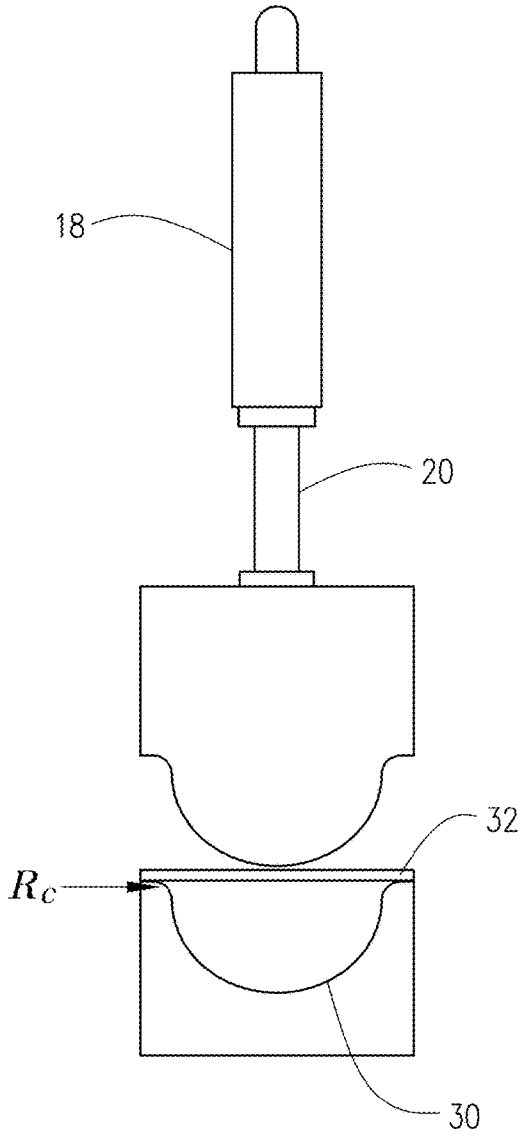
FIGS. 26 and 27 are schematic representations of a single piston acting on a compression chamber.
Figure 27:
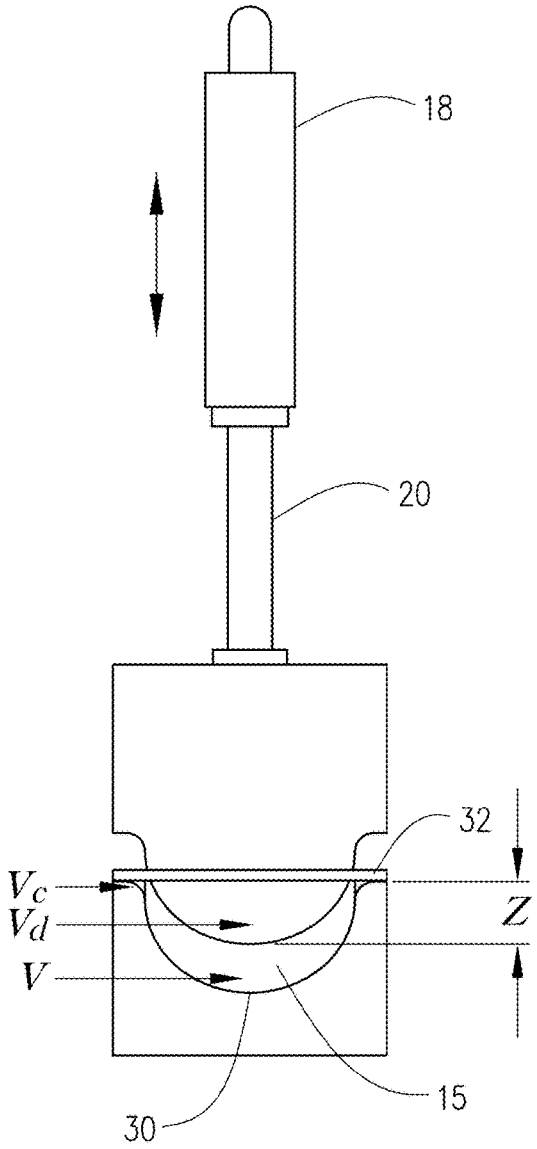

The schematics in FIGS. 26 and 27 depict a geometric model showing a single piston deflecting diaphragm 32. In one example, the shape of the compression chamber 15 is considered to be a chamber with a semi-circular cross section as shown in FIGS. 26 and 27. The radius R of the semicircle is considered to be 0.0127 which is the maximum deflection of the diaphragm 32. Rc in that instance is 0.00254. Graphical representations of the operating conditions of a compressor 10 can be generated using the computational model expressed in FIG. 25 with the mass and energy balance analyses described herein. FIGS. 28-34 are graphical representations of the operating conditions generated from the computational model assuming the shape and dimensions described, and a piston speed of 0.254 m/s.

Figure 28:
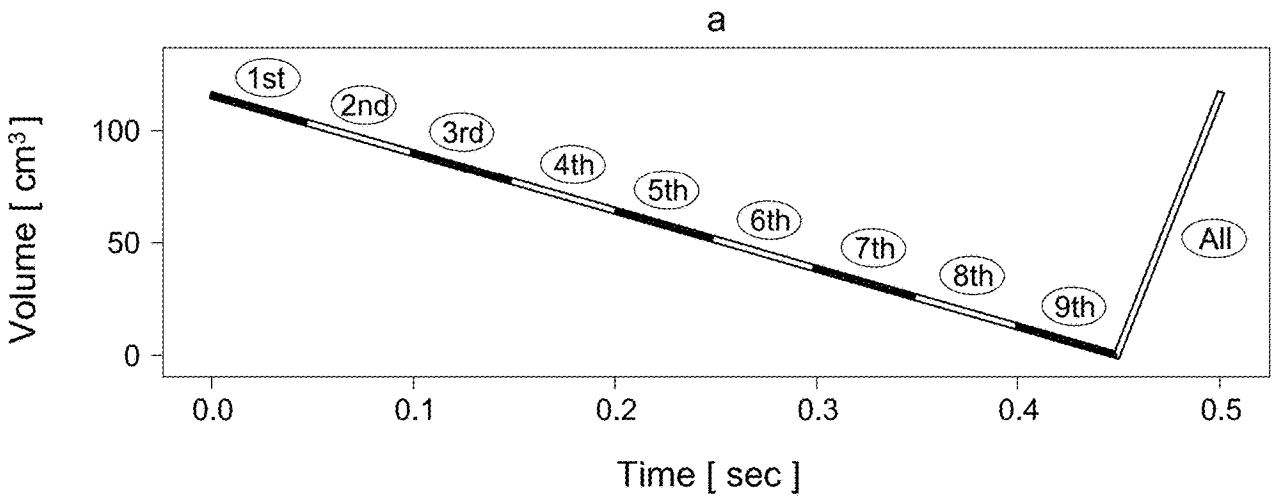
FIG. 28 is a graph showing volume of the compression chamber as a function of time as pistons one through nine in the described embodiment are compressed.

FIG. 28 shows how the volume of the compression chamber 15 changes during one compression cycle for the semi-circular diaphragm arrangement. At the beginning of a cycle, the tenth piston 136 is down. The first to ninth pistons then press the diaphragm 32 in sequence to reduce the compression chamber 15 volume and release the fluid. All of pistons 20 will rise together after the ninth piston is depressed (designated by ALL in the graph). The tenth piston 136 will descend simultaneously to prevent backflow as the remaining nine pistons rise to create suction and draw the fluid into the compression chamber 15 and reach the initial compression chamber volume. The cycle will repeat thereafter. The volume of the compression chamber 15 for the discharge flow area is different for different pivotal pistons.

Figure 29:
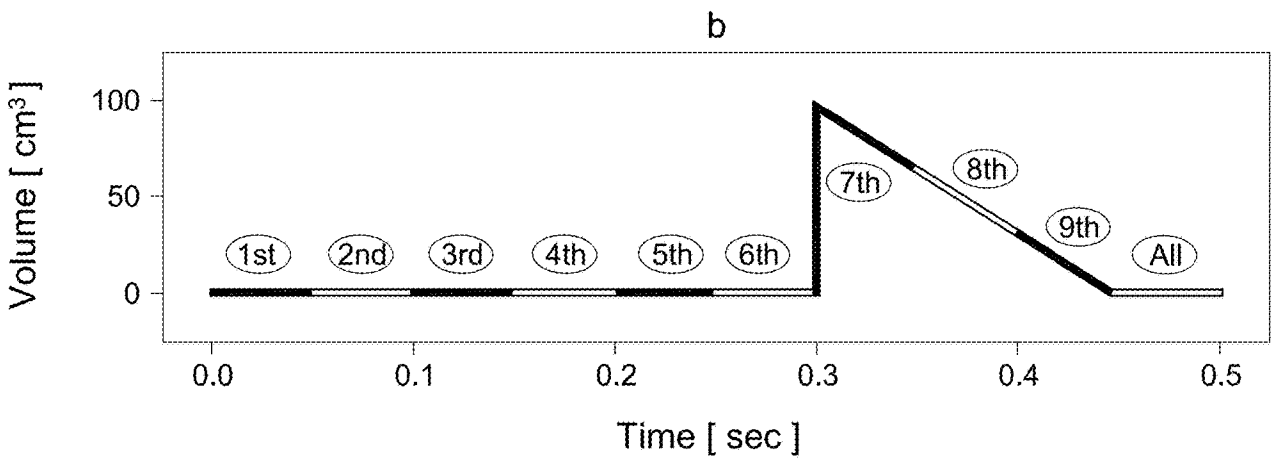
FIG. 29 is a graph showing discharge volume with piston seven as a pivotal piston.

For example, FIG. 29 demonstrates how the discharge volume will change for the pivotal piston seven. In that case, the tenth piston is down at the beginning of a compression cycle, and the first to sixth piston will press the diaphragm sequentially to compress the fluid in compression chamber 15. For pivotal piston seven, when the compressor 10 hits the seventh piston the discharge will start. The seventh to ninth piston will press the diaphragm 32 to move all fluid from the compression chamber 15. During compression and suction, there would be no discharge, so the discharge volume would be zero. The computational model is utilized to show how the volume ratio changes depending on the point at which discharge occurs.

Mass flow is used in the compression process solver algorithm of FIG. 25, and so mass flow changes must be considered. When pistons 20 load the diaphragm 32, the mass flow changes with respect to the area of the compression chamber. The basic equation of mass flow rate for a fluid with a specific heat (γ) is:

$$\dot{m} = \rho v A, \quad \text{(Eq. 7)}$$

The density of the fluid is ρ, working fluid velocity ϑ and area A. To calculate the fluid velocity the Mach number of the flow is calculated using the following relationship, $$Ma = \sqrt{\left[\left(\frac{P_{low}}{P_{high}}\right)^{\left(-\frac{\gamma-1}{\gamma}\right)} - 1\right]\frac{2}{\gamma - 1}}, \quad \text{(Eq. 8)}$$

The compression chamber is considered as a nozzle where pressure ratio is the difference in pressures between the compression chamber and exit control volume. The next unknown function is fluid velocity, which is found from the following equation:

$$\vartheta = \sqrt{\gamma R_g T}\,Ma, \quad \text{(Eq. 9)}$$

Heat transfer is modeled between the working fluid and the walls of the compression chamber at each instant. The quantity may be calculated in a manner known in the art, for example using the method described in the article entitled *Instantaneous Heat Transfer to the Cylinder Wall in Reciprocating Compressors*, Paper 86, 1972 International Compressor Engineering Conference by R. P Adair, E. B. Quayle and J. T. Pearson $$\dot{Q} = h_t A(T_w - T), \quad \text{(Eq. 10)}$$

where Heat transfer coefficient is defined as, $$h_t = 0.0278(1 + 0.38\vartheta)\sqrt{(P^2T^2)}, \quad \text{(Eq. 11)}$$

P is the fluid pressure at the compression and Tw is the wall temperature. The compression process solver and overall energy balance in FIG. 24, converge and specify the guess wall temperature during the iteration by using the secant method.

The leakage model was focused on the leakage between the diaphragm 32 and the surface of cavity 30 when the piston 20 is fully engaged. 1% area of the total compression chamber for single piston is considered as leakage area (Aleakage). The following equation may be used to determine the leakage mass low rate:

$$\dot{m}_{leakage} = \rho\vartheta A_{leakage} \quad \text{(Eq. 12)}$$

where, $$A_{leakage} = \frac{\text{Compression chamber volume for single piston}}{Y}0.01$$

Figure 30:
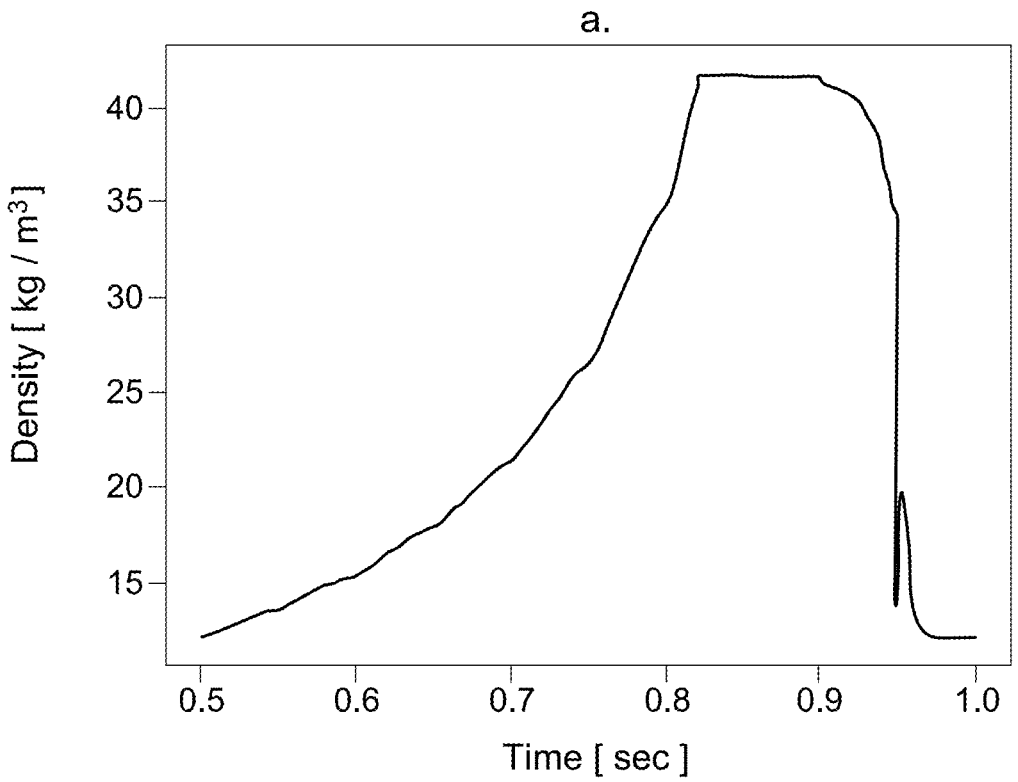
FIG. 30 is a graph showing density for one compression cycle with piston seven as a pivotal piston.

A thermodynamic and the geometric model of the peristaltic compressor 10 was implemented in the computational model, and the operating conditions and results are reflected in FIGS. 30-35. Air was used as the working fluid to run the model. The initial constraints considered were a suction pressure of 104 kPa and a desired discharge pressure of 364 kPa. As is understood from the model, at the initial step, or startup time, (e.g., time=0) all of the conditions are known. For example, the pressure, density, temperature and initial volume are known. The derivatives of the two independent properties (temperature and density) are calculated with the model with respect to displacement of a piston (Z in the analysis) and speed of the piston on its downstroke (s). FIGS. 30 (density of compressor for one cycle), 31 (temperature of the compressor for one cycle) and 32 (pressure-volume for one cycle) show, for the pivotal piston seven how the thermodynamic properties are behaving during the compression given a corresponding volume change associated with the semi-circular compression chamber 15. At the conclusion of a single simulated cycle the model will further calculate the net heat transfer from the process using first a guess value for the compressor wall temperature. This wall temperature is used to estimate the heat loss to the ambient from the compressor. If the heat to the ambient does not match that generated by the compressor the wall temperature is adjusted the process repeats until a final cycle is calculate that balances energy with the ambient.

Figure 31:
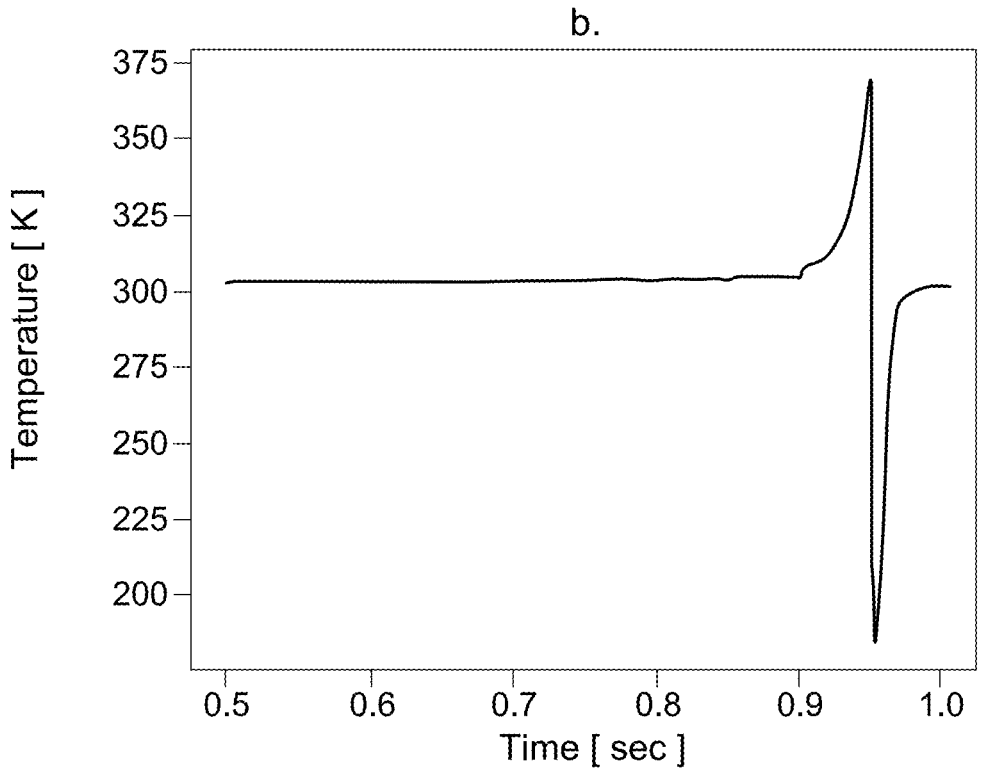
FIG. 31 is a graph showing temperature for one compression cycle with piston seven as a pivotal piston.
Figure 32:
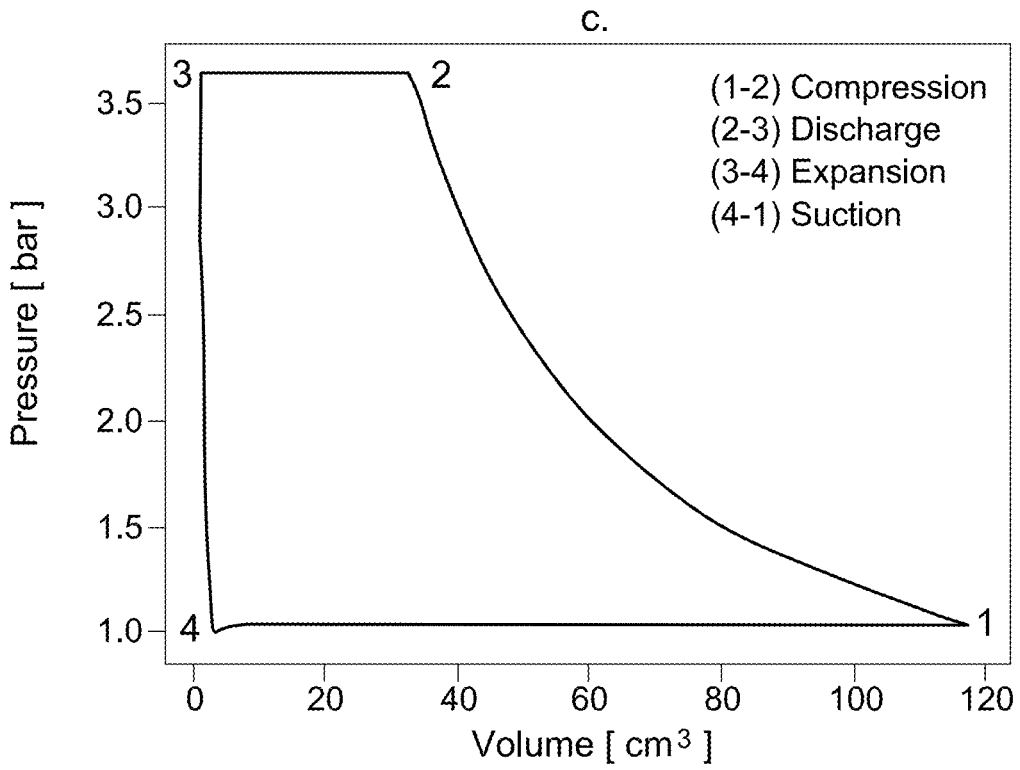
FIG. 32 is a pressure-volume diagram of the apparatus with piston seven as a pivotal piston.

As FIG. 30 shows, the density of the compression chamber 15 increases until the fluid begins to discharge. As discharging of fluid occurs the mass velocity and heat-transfer of the compression chamber start decreasing. Therefore, the density begins to decrease when discharge starts and returns to its initial position when the fluid starts entering the compression chamber 15 again. FIG. 31 highlights that the temperature of the compressor rises modestly until the final piston compresses at which time the temperature increases exponentially. Similar to density, when the pistons 20 start to open the inlet segment for the fluid flow, the pressure drops significantly and volume of the compression chamber starts increasing from zero. For that reason, the temperature starts dropping during the expansion and reaches to its initial condition when the suction is completed. FIG. 32 shows the fluid pressure as a function of compression chamber volume for the peristaltic compressor 10. This pressure-volume diagram is also referred to as an indicator diagram.

Figure 33:
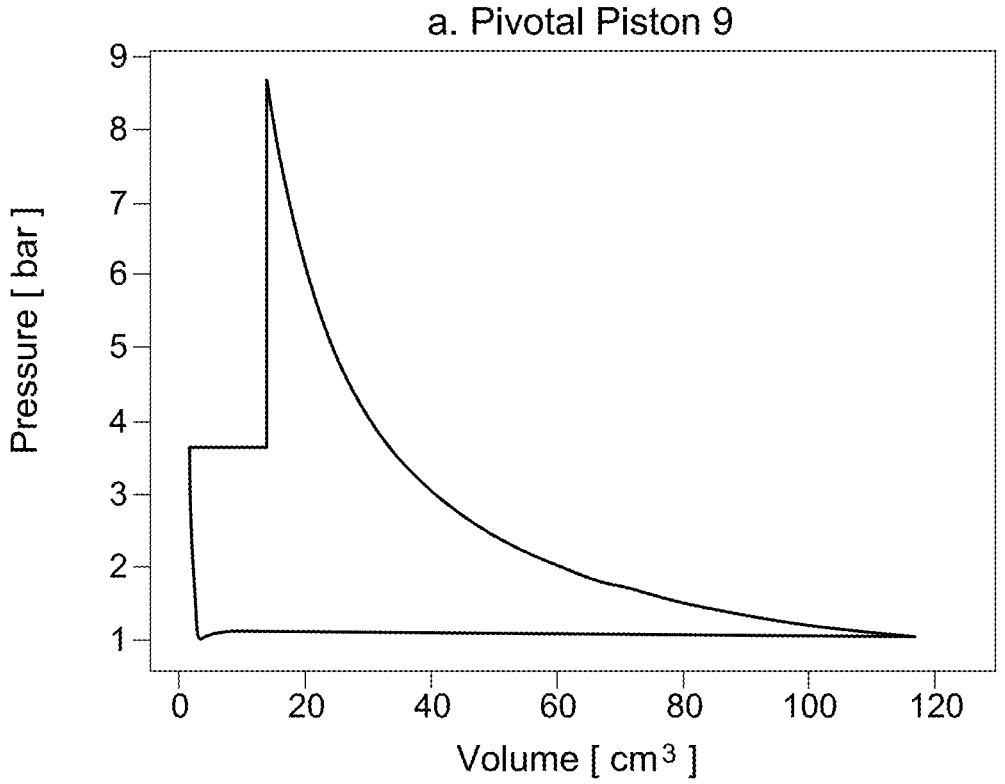
FIGS. 33-35 are pressure-volume diagrams of the apparatus with different pivotal pistons.
Figure 34:
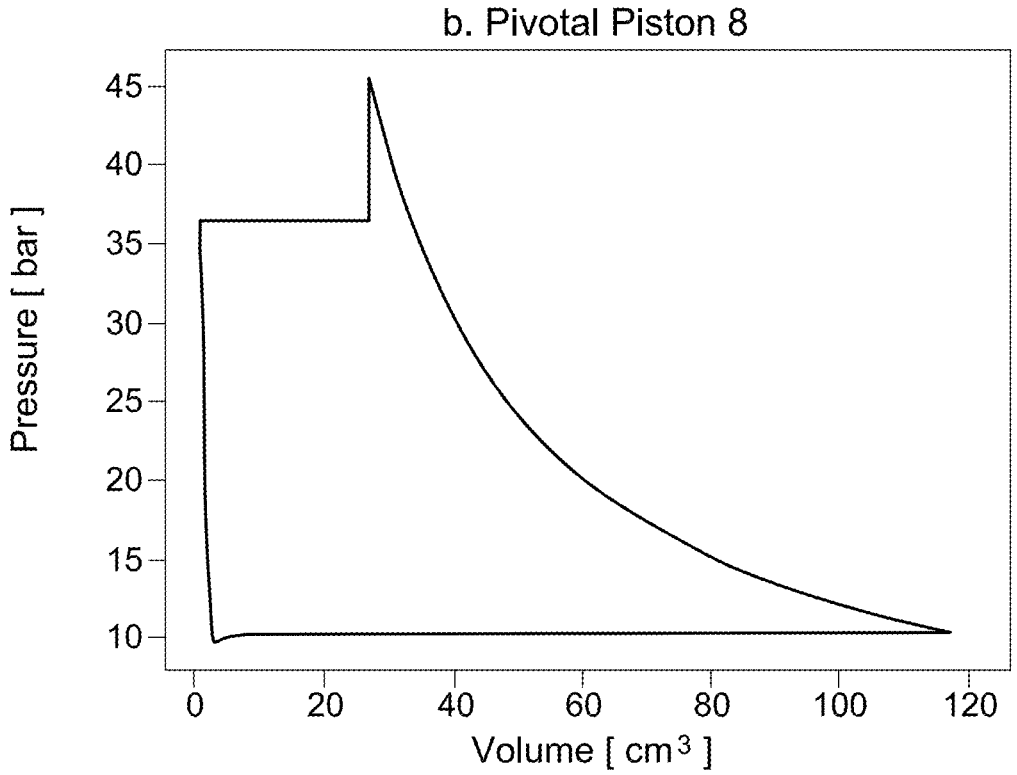
Figure 35:
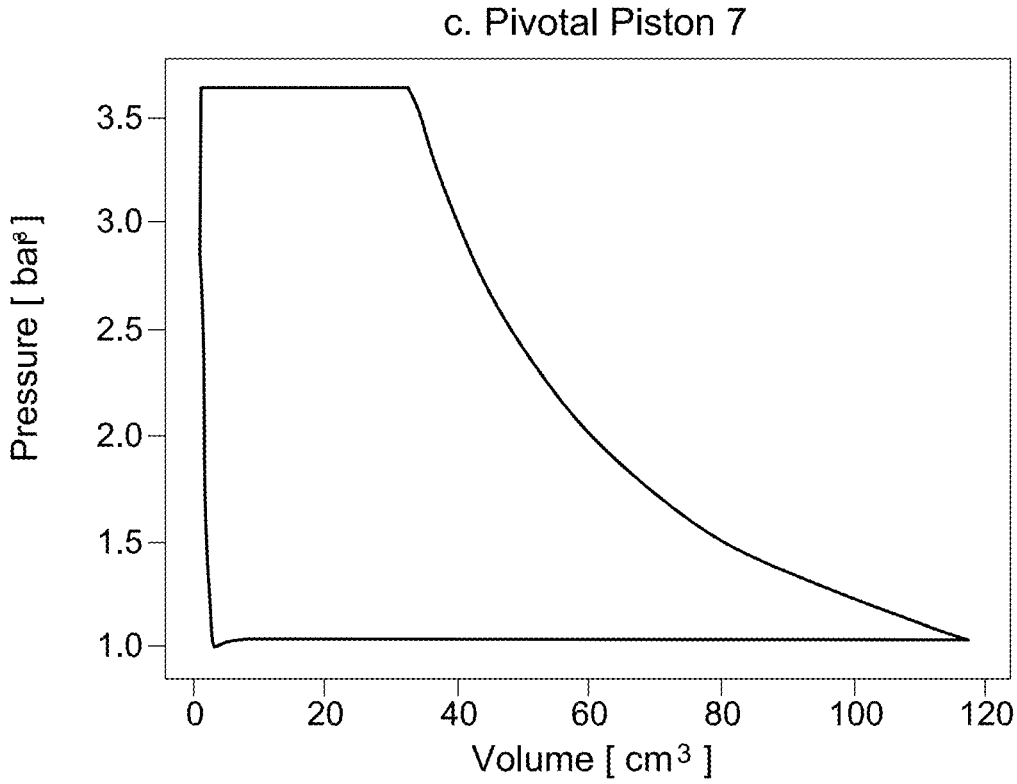

FIGS. 33-35 reflect compression chamber pressures for different pivotal pistons from the computational model. Referring back to the initial conditions identified above, the computational model will reflect discharge when the desired discharge pressure is reached, in this case 364 kPa, and when the specified pivotal piston is reached. In other words, discharge will occur when the discharge pressure is reached and when the displacement assembly utilized has decreased the volume of the compression chamber 15 to the selected volume ratio as compared with the initial volume. FIG. 33 shows that the internal chamber pressure at the time of discharge for pivotal piston nine greatly exceeds the system discharge pressure. In other words, the internal pressure of the compression chamber at the time of discharge is higher than the desired discharge pressure. As noted, the desired discharge pressure may be for example a selected pressure that is based on the pressure conditions of an overall system in which the apparatus 10 is used. This over-compression is a result of the volume change when compressing pistons one to eight exceeding the volume change required to achieve the system discharge pressure. This requires more work (power) to execute and is therefore a loss. The reconfigurable nature of the compressor 10, along with the ability to utilize different sequences for the pistons, allows the volume ratio to be adjusted on the fly. This is reflected in FIGS. 34 and 35 which show results for the same system conditions with two different pivotal pistons. Using piston eight as the pivotal (FIG. 34) also shows over pressure, or over-compression but to a lesser degree than with pivotal piston nine. When the pivotal piston is at seven (FIG. 35) the system presents with neither over or under compression. This will result in minimal power and maximize compressor efficiency. A scroll compressor, for example, does not have the ability to modify its volume ratio, so if an operating condition results in significant over-compression the scroll compressor will be less efficient. In contrast, an apparatus 10 as described can overcome that inefficiency by adjusting its volume ratio on the fly.

Using the given exemplary operating conditions, it was determined that piston seven was the proper pivotal piston to accomplish the proper volume ratio and thus maintain the internal pressure of the compression chamber at the proper pressure to accomplish the selected discharge pressure. It is understood that the parameters mentioned, namely volume ratio and pressure can be accomplished utilizing other displacement assemblies. In other words, the selection of pivotal pistons nine, eight and seven as described achieve different volume ratios because of the adjustment in the length of chamber that is compressed. Other methods and apparatus might be used to change the volume ratio to accomplish the same result.

The apparatus for compressing fluid 10 as described provides for the adjustment of the volume ratio, and thus the internal pressure of the compression chamber 15 (i.e., during operation). Given a set of operating conditions, the geometry of the linear compressor 10 and a desired discharge pressure, the length of the linear compression chamber to be compressed may be determined as described. If a selected length, and corresponding selected volume ratio creates an under pressure or overpressure situation the length of the portion of the compressor chamber may be changed until the internal pressure of the compression chamber is at the discharge pressure at the time of discharge. By volume ratio, what is meant is the amount of the linear chamber compressed as compared to the non-compressed portion. For example, assuming a linear compression chamber 15 having a length of one meter, and one/half (0.5 meters) being compressed the ratio would be 1:1. If 0.7 meters are compressed the ratio would be 7:3, which corresponds to seventy percent of the compression chamber compressed, and only thirty percent containing the fluid that originally filled the entire compression chamber 15.

An apparatus for compressing fluid 10 thus can be adjusted during operation. If during operation, the apparatus 10 is over or under pressured, then the volume ratio can be adjusted so that the internal pressure of the compression chamber at the time of discharge is at the desired discharge pressure, which may be a discharge pressure range. In other words, the desired discharge pressure may be between two specified pressure limits. If the internal pressure of the compression chamber 15 deviates from the discharge pressure at the time of discharge, the volume ratio of the compression chamber can be adjusted, which changes the internal pressure of the compression chamber to correct an over or under pressure operation.

The method of operating an apparatus for compressing a fluid may comprise for example determining inlet conditions for the linear compressor and a fluid used in the compressor, and identifying a desired discharge pressure. The method may further comprise establishing a volume ratio of the compression chamber to accomplish the desired discharge pressure, sequentially compressing the compressor chamber to achieve the volume ratio, and discharging the fluid from a discharge end of the compression chamber once the volume ratio is achieved. The method may further comprise monitoring the internal pressure of a compression chamber and adjusting the volume ratio of the compression chamber if the internal pressure of the compression chamber deviates from the desired discharge pressure at the time of discharge. One way to compress the compression chamber, and thereby change the volume ratio, is using reciprocating pistons as described and sequentially compressing the compression chamber until a pivotal piston position is reached. Other electromechanical means can be utilized to compress the compression chamber in a sequential, or progressive manner for the same purpose.

In one embodiment the compressor may be programmatically operated utilizing a PLC so that, based on the initial inputs, it generates the desired volume ratio and discharge pressure, which may be a discharge pressure range, as it cycles through compression cycles. The operator can adjust the volume ratio based on the monitored internal pressure of the compression chamber 15 to maintain the internal compression chamber pressure at the desired discharge, which as noted may be a discharge pressure range. The volume ratio is adjusted by adjusting the length of the compression chamber 15 that is compressed. The adjustment can be performed by an operator controlling a PLC as noted, or in one embodiment the internal pressure of the compression chamber 15 can be monitored, and a signal sent to the PLC to adjust the length of the compression chamber to be compressed when the deviation from discharge pressure is outside the acceptable range.

Figure 36:
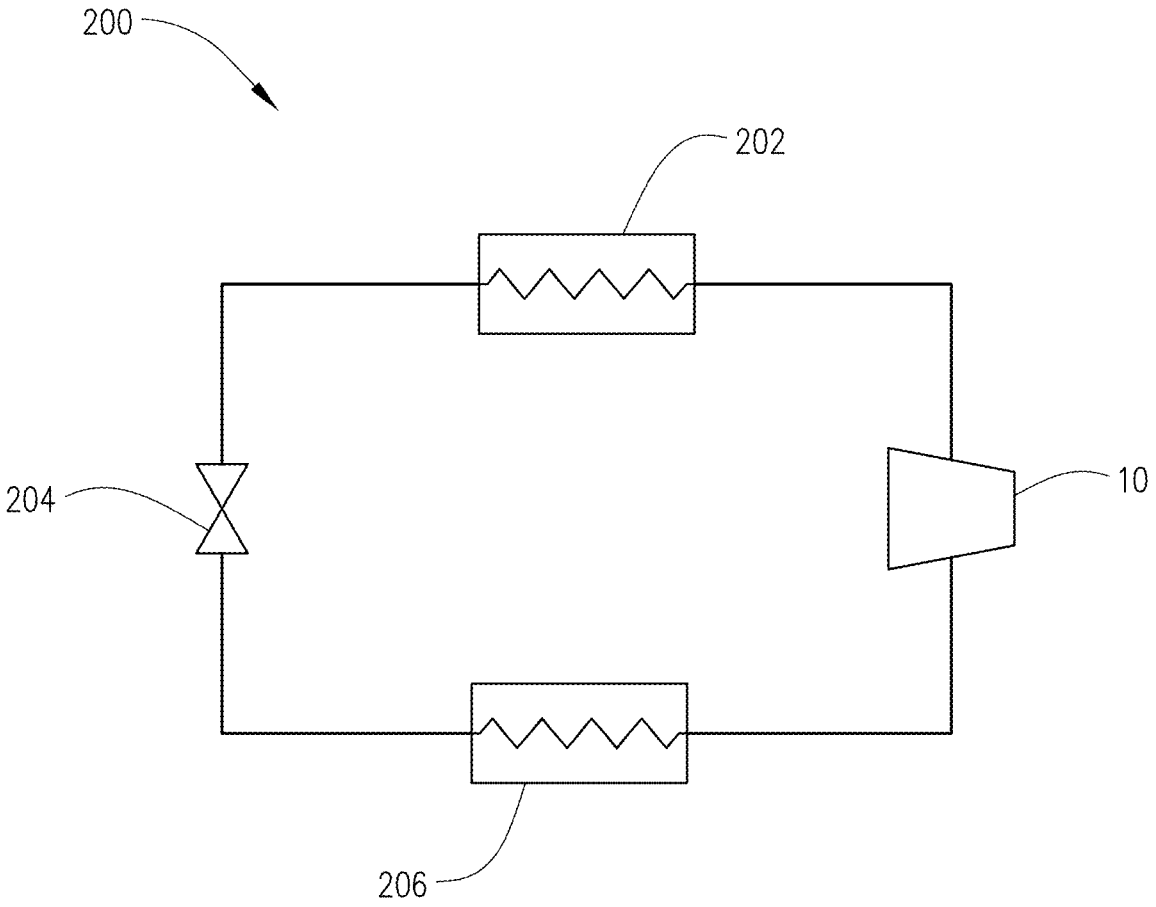
FIG. 36 is a schematic representation of a vapor compression system.

One use for the apparatus 10 described herein might be for example in a vapor compression system utilized in HVAC units. A vapor compression system 200 is shown schematically in FIG. 36 and includes the peristaltic compressor 10, a condenser 202, an expansion valve 204 and an evaporator 206. In a vapor compression refrigeration cycle a fluid, such as a refrigerant will enter the compressor at a low temperature and low pressure. The apparatus 10 would compress the fluid to raise the temperature and pressure. Thus, the fluid, for example, refrigerant, would leave the compressor and enter the condenser.

Next, the fluid would enter the condenser which is essentially a heat exchanger. Heat is transferred from the refrigerant to a flow of water for example. Fluid is typically at a constant pressure as it flows through the condenser. Fluid passes from the condenser into an evaporator. In so doing, the fluid may pass through an expansion valve or other control or throttling valve. Typically, such a valve will maintain a pressure differential between the high pressure side (i.e., that fluid leaving the condenser) and the low pressure side (i.e., the pressure of the fluid leaving the expansion valve). Heat is extracted at the evaporation stage at a low pressure and temperature. The cycle will repeat as the suction from the apparatus 10 will draw the fluid therein so that the cycle can be repeated.

The apparatus 10 is adjustable on the fly in such a system as described above. In other words, the pressure in the overall vapor compression system 200 will be known, so that the discharge pressure can be selected to meet that overall system pressure. The internal compression chamber pressure 15 is continuously monitored, and if at the time of discharge that internal pressure deviates from the system pressure, which will be the same as the discharge pressure, the volume ratio and the attendant internal pressure can be adjusted on the fly (during operation) as described. The table below sets forth the nomenclature for the analysis herein. The table is repeated in FIG. 36.

EXAMPLE EMBODIMENTS

Embodiment 1. An apparatus for compressing a fluid comprising a linear compression chamber having a fluid inlet and a fluid outlet; and a displacement assembly spaced from the linear compression chamber and actuable to engage the linear compression chamber and displace a working fluid linearly in the linear compression chamber to decrease the volume of a fluid in the linear compression chamber and thereby increase the fluid pressure in the linear compression chamber.

Embodiment 2. The embodiment of claim 1, the compression chamber comprising a longitudinally extending chamber cavity defined in a chamber body; and a flexible diaphragm covering the cavity, the flexible diaphragm being engageable by the displacement assembly.

Embodiment 3. The apparatus of either of embodiments 1 or 2, the displacement assembly comprising a plurality of reciprocable pistons having a piston rod and a piston head, the pistons reciprocable between a fully retracted position in which the piston head is spaced from the compression chamber and a fully extended position in which the piston head extends into the compression chamber to decrease the volume therein.

Embodiment 4. The apparatus of embodiment 3, the flexible diaphragm being in contact with the surface of the cavity when a piston is in the fully extended position.

Embodiment 5. The apparatus of either of embodiments 3 or 4, the plurality of pistons comprising: an inlet piston; an outlet piston; and a plurality of intermediate pistons, the outlet piston being in the fully extended position to prevent fluid discharge through the fluid outlet at a beginning of a single compression cycle and being lifted to a fully retracted position to allow fluid discharge at the end of a single compression cycle.

Embodiment 6. The apparatus of any of embodiments 2-5, the displacement assembly comprising a plurality of reciprocating pistons each having a piston rod and a piston head, the piston head having the same profile as the profile of the chamber cavity.

Embodiment 7. The apparatus of any of embodiments 1-6, the displacement assembly being sequentially actuable to generate linear movement of the fluid in the compression chamber.

Embodiment 8. An apparatus for compressing a fluid comprising: a linear compression chamber having a fluid inlet and a fluid outlet; and a compression assembly actuable to engage the linear compression chamber and decrease the volume of the linear compression chamber from an initial chamber volume to a discharge volume prior to discharge of fluid through the fluid outlet.

Embodiment 9. The embodiment of embodiment 8, the discharge volume being adjustable during operation of the apparatus.

Embodiment 10. The apparatus of either of embodiments 8 or 9, the compression assembly comprising a plurality of reciprocable pistons movable in and out of engagement with the linear compression chamber.

Embodiment 11. The apparatus of embodiment 10, the reciprocable pistons actuable in a plurality of selected sequences.

Embodiment 12. The apparatus of either of embodiments 10 or 11, the linear compression chamber comprising a cavity defined in a chamber body and a flexible diaphragm extending across a cavity opening along the length of the cavity.

Embodiment 13. The apparatus of any of claims 8-12, the compression assembly comprising an inlet piston, an outlet piston and a plurality of intermediate pistons, the outlet piston being in a fully extended position to prevent fluid discharge from the compression chamber at the beginning of a compression cycle.

Embodiment 14. An apparatus for compressing a fluid comprising: a cavity defined in a chamber body and extending longitudinally along a linear axis from an inlet to an outlet of the chamber body; a flexible diaphragm extending across the cavity for a length of the chamber body, the flexible diaphragm and cavity defining a compression chamber; and a plurality of pistons actuable to engage the flexible diaphragm.

Embodiment 15. The embodiment of claim 14, the pistons comprising pistons actuable to engage the flexible diaphragm in a selected sequence.

Embodiment 16. The apparatus of any of embodiments 14-15, the pistons actuable in a plurality of selected sequences.

Embodiment 17. The apparatus of any of claims 14-16, the pistons comprising a piston rod and a piston head, the piston head having a profile that matches a profile of the cavity.

Embodiment 18. The apparatus of any of embodiments 14-17, the piston head defining a semi-cylindrical profile.

Embodiment 19. The apparatus of any of embodiments 14-18, the pistons operable to progressively decrease the volume of the chamber along the linear axis thereof.

Embodiment 20. A vapor compression system comprising the apparatus of any of embodiments 14-19, an evaporator upstream from the apparatus and fluidically connected thereto; a condenser downstream from the apparatus and fluidically connected thereto; and, an expansion valve positioned in a fluid line connecting the condenser and the evaporator.

Embodiment 21. A method of compressing a fluid comprising: filling a linear compression chamber having a fluid inlet and a fluid outlet with a fluid to be compressed; progressively compressing the linear compression chamber to decrease the volume therein; and discharging the fluid through the fluid outlet of the linear compression chamber when a selected volume ratio is reached in the chamber.

Embodiment 22. The method of embodiment 21 further comprising continuously performing the filling, progressively compressing and discharging steps of embodiment 21.

Embodiment 23. The method of embodiment 22 further comprising monitoring an internal compression chamber pressure; and adjusting the volume ratio without stopping the continuous filling, progressively compressing and discharging steps if an internal compression chamber pressure of the linear compression chamber deviates from a desired discharge pressure at the time of discharge through the fluid outlet.

Embodiment 24. The method of any of embodiments 21-23 further comprising creating a compression pocket between the fluid inlet and the fluid outlet of the linear compression chamber, the progressively compressing step comprising compressing the compression pocket.

Embodiment 25. The method of embodiment 24 further comprising using a displacement assembly spaced from the linear compression chamber to compress the compression pocket.

Embodiment 26. The method of embodiment 25, the displacement assembly comprising a plurality of reciprocating pistons, the filling step comprising blocking flow through the fluid outlet with a discharge piston, and creating a compression pocket comprising extending a piston upstream from the discharge piston into the compression chamber.

Embodiment 27. A fluid compression process comprising: providing a linear compression chamber having a fluid inlet and a fluid outlet; closing the fluid outlet to prevent flow therethrough; filling the compression chamber with a fluid; creating a compression pocket filled with the fluid in the compression chamber; compressing the compression pocket in the compression chamber to decrease the volume of the compression pocket in the compression chamber; discharging the fluid through the fluid outlet when the volume ratio in the compression pocket is at a selected volume ratio; and continuously repeating the filling, creating, compressing and discharging steps.

Embodiment 28. The compression process of embodiment 27, comprising: monitoring an internal pressure of the compression chamber; and altering the volume ratio of the compression pocket in the compression chamber if at the time of the discharging step the monitored pressure deviates from the desired discharge pressure.

Embodiment 29. The compression process of either of embodiments 27-28 further comprising: using a displacement assembly spaced from the linear compression chamber to compress the compression pocket.

Embodiment 30. The compression process of embodiment 29, the displacement assembly comprising a plurality of reciprocating pistons, the closing step comprising blocking flow through the fluid discharge with a discharge piston and creating a compression pocket comprising extending a piston upstream from the discharge piston into the compression chamber.

Embodiment 31. The compression process of any of embodiments 27-30, an initial length of the compression pocket extending from an inlet piston to a discharge piston.

| NOMENCLATURE | |
|---|---|
| A | Area of the compression chamber |
| $A_{leakage}$ | Leakage Area |
| $C_V$ | Specific volume |
| h | Displacement of the piston when acting on the curve segment |
| $h_{in}$ | Enthalpy in |
| $h_{out}$ | Enthalpy out |
| $h_t$ | Heat transfer constant |
| Ma | Mach number |
| $\dot{m}_{in}$ | Mass flow in |
| $\dot{m}_{out}$ | Mass flow out |
| $\dot{m}_{leakage}$ | Mass flow leakage |
| P | Pressure of the fluid |
| $\dot{Q}$ | Heat transfer rate |
| R | Radius of the piston/compression chamber |
| $R_c$ | Radius of the curve segment in the compression chamber |
| $R_g$ | Gas Constant |
| S | Actuation speed |
| T | Temperature of the fluid |
| $T_w$ | Wall temperature |
| u | Internal energy |
| V | Volume of the semi-circular compression chamber |
| $V_c$ | Volume of the curve segment in the compression chamber |
| $V_d$ | Volume of the deflected segment |
| Y | Length of the piston |
| Z | Displacement of the piston |
| ρ | Density of the fluid |
| $\dot{\theta}$ | Fluid velocity |
| γ | Specific heat |

What is claimed is:

1. An apparatus for compressing a fluid comprising:

a linear compression chamber having a fluid inlet and a fluid outlet; and a displacement assembly spaced from the linear compression chamber and actuable to engage the linear compression chamber and displace a working fluid linearly in the linear compression chamber to decrease the volume of a fluid in the linear compression chamber and thereby increase the fluid pressure in the linear compression chamber.

2. The apparatus of claim 1, the compression chamber comprising:

a longitudinally extending chamber cavity defined in a chamber body; and a flexible diaphragm covering the cavity, the flexible diaphragm being engageable by the displacement assembly.

3. The apparatus of claim 2, the displacement assembly comprising a plurality of reciprocating pistons each having a piston rod and a piston head, the piston head having the same profile as the profile of the chamber cavity.

4. The apparatus of claim 1, the displacement assembly comprising a plurality of reciprocable pistons having a piston rod and a piston head, the pistons reciprocable between a fully retracted position in which the piston head is spaced from the compression chamber and a fully extended position in which the piston head extends into the compression chamber to decrease the volume therein.

5. The apparatus of claim 4, further comprising a flexible diaphragm being in contact with the surface of the cavity when a piston is in the fully extended position.

6. The apparatus of claim 3, the plurality of pistons comprising:

an inlet piston;

an outlet piston; and a plurality of intermediate pistons, the outlet piston being in the fully extended position to prevent fluid discharge through the fluid outlet at a beginning of a single compression cycle and being lifted to a fully retracted position to allow fluid discharge at the end of a single compression cycle.

7. The apparatus of claim 1, the displacement assembly being sequentially actuable to generate linear movement of the fluid in the compression chamber.

8. An apparatus for compressing a fluid comprising:

a linear compression chamber having a fluid inlet and a fluid outlet; and a compression assembly actuable to engage the linear compression chamber and decrease the volume of the linear compression chamber from an initial chamber volume to a discharge volume prior to discharge of fluid through the fluid outlet.

9. The compressor of claim 8, the discharge volume being adjustable during operation of the apparatus.

10. The apparatus of claim 8, the compression assembly comprising a plurality of reciprocable pistons movable in and out of engagement with the linear compression chamber.

11. The apparatus of claim 10, the reciprocable pistons actuable in a plurality of selected sequences.

12. The apparatus of claim 10, the linear compression chamber comprising a cavity defined in a chamber body and a flexible diaphragm extending across a cavity opening along the length of the cavity.

13. The apparatus of claim 10, the compression assembly comprising an inlet piston, an outlet piston and a plurality of intermediate pistons, the outlet piston being in a fully extended position to prevent fluid discharge from the compression chamber at the beginning of a compression cycle.

14. An apparatus for compressing a fluid comprising:

a cavity defined in a chamber body and extending longitudinally along a linear axis from an inlet to an outlet of the chamber body;

a flexible diaphragm extending across the cavity for a length of the chamber body, the flexible diaphragm and cavity defining a compression chamber; and a plurality of pistons actuable to engage the flexible diaphragm.

15. The apparatus of claim 14, the pistons comprising pistons actuable to engage the flexible diaphragm in selected sequences.

16. The apparatus of claim 15, the pistons actuable in a plurality of selected sequences.

17. The apparatus of claim 14, the pistons comprising a piston rod and a piston head, the piston head having a profile that matches a profile of the cavity.

18. The apparatus of claim 17, the piston head defining a semi-cylindrical profile.

19. The apparatus of claim 14, the pistons operable to progressively decrease the volume of the chamber along the linear axis thereof.

20. A vapor compression system comprising:

the apparatus of claim 14;

an evaporator upstream from the apparatus and fluidically connected thereto;

a condenser downstream from the apparatus and fluidically connected thereto; and, an expansion valve positioned in a fluid line connecting the condenser and the evaporator.

21. A method of compressing a fluid comprising: filling a linear compression chamber having a fluid inlet and a fluid outlet with a fluid to be compressed; progressively compressing the linear compression chamber to decrease the volume therein; and discharging the fluid from a discharge end through the fluid outlet of the linear compression chamber when a selected volume ratio is reached in the chamber.

22. The method of claim 21, further comprising continuously performing the filling, progressively compressing and discharging steps of claim 21.

23. The method of claim 22, further comprising: monitoring an internal compression chamber pressure; and adjusting the volume ratio without stopping the continuous filling, progressively compressing and discharging steps if an internal compression chamber pressure of the linear compression chamber deviates from a desired discharge pressure at the time of discharge through the fluid outlet.

24. The method of claim 21, further comprising creating a compression pocket between the fluid inlet and the fluid outlet of the linear compression chamber, the progressively compressing step comprising compressing the compression pocket.

25. The method of claim 24, further comprising using a displacement assembly spaced from the linear compression chamber to compress the compression pocket.

26. The method of claim 25, the displacement assembly comprising a plurality of reciprocating pistons, the filling step comprising blocking flow through the fluid outlet with a discharge piston, and creating a compression pocket comprising extending a piston upstream from the discharge piston into the compression chamber.

27. A fluid compression process comprising:

providing a linear compression chamber having a fluid inlet and a fluid outlet;

closing the fluid outlet to prevent flow therethrough;

filling the compression chamber with a fluid;

creating a compression pocket filled with the fluid in the compression chamber;

compressing the compression pocket in the compression chamber to decrease the volume of the compression pocket in the compression chamber;

discharging the fluid through the fluid outlet when the volume ratio in the compression pocket is at a selected volume ratio; and continuously repeating the filling, creating, compressing and discharging steps.

28. The compression process of claim 27, comprising: monitoring an internal pressure of the compression chamber:

and altering the volume ratio of the compression pocket in the compression chamber if at the time of the discharging step the monitored pressure deviates from the desired discharge pressure.

29. The compression process of claim 27, further comprising: using a displacement assembly spaced from the linear compression chamber to compress the compression pocket.

30. The compression process of claim 29, the displacement assembly comprising a plurality of reciprocating pistons, the closing step comprising blocking flow through the fluid discharge with a discharge piston and creating a compression pocket comprising extending a piston upstream from the discharge piston into the compression chamber.

31. The compression process of claim 30, an initial length of the compression pocket extending from an inlet piston to the discharge piston.

* * * * *